US008973776B1

(12) United States Patent
Buck

(10) Patent No.: US 8,973,776 B1
(45) Date of Patent: Mar. 10, 2015

(54) CUP WITH NESTABLE FOOD CONTAINER AND COVER

(71) Applicant: Top-That!, LLC, Encinitas, CA (US)

(72) Inventor: Ronald Mark Buck, Encinitas, CA (US)

(73) Assignee: Top-That!, LLC, Encinitas, CA (US)

( * ) Notice: Subject to any disclaimer, the term of this patent is extended or adjusted under 35 U.S.C. 154(b) by 0 days.

(21) Appl. No.: 14/279,329

(22) Filed: May 16, 2014

(51) Int. Cl.
*A47G 19/22* (2006.01)

(52) U.S. Cl.
CPC ..... *A47G 19/2222* (2013.01); *A47G 19/2272* (2013.01)
USPC ..... 220/522; 220/521; 220/528; 220/705

(58) Field of Classification Search
CPC ..... B65D 81/3205; B65D 81/32; B65D 81/3261; B65D 51/28; B65D 51/24; A47G 19/2222
USPC ..... 220/522, 521, 709, 705, 212.5, 212, 220/528; 206/514, 217, 216, 546, 541, 223; 215/388, 229, 228, 387
See application file for complete search history.

(56) References Cited

U.S. PATENT DOCUMENTS

| | | | | |
|---|---|---|---|---|
| 1,665,289 | A | | 4/1928 | Weaver |
| 2,931,230 | A | * | 4/1960 | Lowery ..... 73/427 |
| 3,288,344 | A | * | 11/1966 | Woollen et al. ..... 229/103.1 |
| 3,323,706 | A | | 6/1967 | Gereke |
| 3,413,128 | A | | 11/1968 | Steinbarth et al. |
| 3,421,654 | A | | 1/1969 | Hexel |
| 3,679,089 | A | | 7/1972 | Swett et al. |
| 4,054,205 | A | | 10/1977 | Blow, Jr. et al. |
| 4,074,827 | A | | 2/1978 | Labe, III |
| 4,091,953 | A | | 5/1978 | Daenen |
| 4,627,537 | A | | 12/1986 | Rogers |
| 4,699,299 | A | | 10/1987 | Gach |
| 5,145,646 | A | | 9/1992 | Tyranski |
| 5,283,140 | A | | 2/1994 | Netz et al. |
| 5,310,072 | A | | 5/1994 | Matusovsky et al. |
| 5,318,787 | A | | 6/1994 | Brauner et al. |
| 5,503,858 | A | | 4/1996 | Reskow |
| 5,743,423 | A | | 4/1998 | Franco |

(Continued)

FOREIGN PATENT DOCUMENTS

| | | |
|---|---|---|
| EP | 1397986 | 3/2004 |

OTHER PUBLICATIONS

International Search Report Dated Mar. 19, 2013, 14 pages.

(Continued)

*Primary Examiner* — Robert J Hicks
(74) *Attorney, Agent, or Firm* — ARC IP Law, PC; Joseph J. Mayo

(57) ABSTRACT

A cup with nestable food container and cover includes at least one wall that defines at least one container body and a plurality of downward oriented cavities. The cup includes a lower and upper cup body a portion of which defines a fill line that indicates a volume of beverage to fill the cup with. The upper cup body holds the food container, and the at least one container body may descend into the annular opening of the cup down to the fill line. Each of the plurality of downward oriented cavities include a bottom outer corner portion, such that at least one of the plurality of downward oriented cavities may rest on the portion that is wider in the upper cup body. The at least one container and at least one cover may include at least one cavity that may hold at least one independent drop-in container and cover.

28 Claims, 14 Drawing Sheets

(56) References Cited

U.S. PATENT DOCUMENTS

| | | | | |
|---|---|---|---|---|
| D397,911 | S | 9/1998 | Waldmann | |
| 5,954,195 | A | 9/1999 | Krueger et al. | |
| 6,085,919 | A | 7/2000 | Singer | |
| 6,119,884 | A | 9/2000 | Lowry | |
| 6,299,014 | B1 | 10/2001 | Nava et al. | |
| 6,338,417 | B1 | 1/2002 | Ferraro | |
| 6,412,526 | B2 | 7/2002 | Castillo | |
| 6,425,480 | B1 | 7/2002 | Krueger et al. | |
| 6,528,105 | B1 | 3/2003 | Gerhart et al. | |
| 6,706,297 | B1 | 3/2004 | Toth et al. | |
| 6,793,075 | B1 | 9/2004 | Jeter | |
| 7,063,229 | B2 * | 6/2006 | Westerhof et al. | 220/506 |
| 7,111,748 | B2 | 9/2006 | Cha | |
| 7,159,732 | B2 | 1/2007 | Smith et al. | |
| 7,387,063 | B2 | 6/2008 | Vu et al. | |
| 7,588,275 | B2 | 9/2009 | Borg | |
| 7,594,584 | B2 | 9/2009 | Durdon et al. | |
| 7,721,911 | B2 | 5/2010 | Chou | |
| D635,855 | S | 4/2011 | Smith et al. | |
| D637,079 | S | 5/2011 | Brown et al. | |
| 8,006,854 | B2 | 8/2011 | Waugh | |
| 8,574,647 | B1 * | 11/2013 | Gunderson | 426/115 |
| 2004/0089662 | A1 | 5/2004 | Smith et al. | |
| 2005/0035011 | A1 | 2/2005 | McRobbie | |
| 2005/0115845 | A1 | 6/2005 | Cho | |
| 2005/0178688 | A1 | 8/2005 | Hasson | |
| 2005/0205437 | A1 | 9/2005 | Huffman et al. | |
| 2006/0060589 | A1 | 3/2006 | Lee | |
| 2006/0096983 | A1 | 5/2006 | Patterson | |
| 2007/0029322 | A1 | 2/2007 | Durdon et al. | |
| 2007/0278122 | A1 * | 12/2007 | McCumber et al. | 206/514 |
| 2008/0099481 | A1 | 5/2008 | D'Amato | |
| 2008/0230541 | A1 | 9/2008 | Bayss et al. | |
| 2009/0065377 | A1 | 3/2009 | Olomi et al. | |
| 2009/0250479 | A1 | 10/2009 | Kaufman et al. | |
| 2009/0272390 | A1 | 11/2009 | Blondeel | |
| 2011/0248033 | A1 | 10/2011 | Mehrvijeh | |
| 2011/0266295 | A1 | 11/2011 | Yacktman | |
| 2014/0175103 | A1 * | 6/2014 | Oh | 220/600 |

OTHER PUBLICATIONS

International Preliminary Report on Patentability and Written Opinion received for PCT Application No. PCT/US2012/054032, dated Mar. 20, 2014, 10 pages.

International Search Report and Written Opinion issued for PCT Appl. No. PCT/US2013/070630, dated Mar. 13, 2014, 6 pages.

International Search Report and Written Opinion issued for PCT Appl. No. PCT/US2013/070632, dated Mar. 13, 2014, 6 pages.

International Search Report and Written Opinion issued for PCT Appl. No. PCT/US2014/010181, dated Apr. 24, 2014, 7 pages.

* cited by examiner

CUP WITH NESTABLE FOOD CONTAINER AND COVER

BACKGROUND OF THE INVENTION

1. Field of the Invention

One or more embodiments of the invention are related to the field of containers. More particularly, but not by way of limitation, one or more embodiments of the invention include a cup with nestable food container and cover, wherein the food container serves as a lid for the cup and may include one or more cavities to hold food or independent drop-in containers. The food container enables simultaneous or intermittent access of the contents of the food container and attached cup without disengagement of the food container from the cup. Furthermore, according to one or more embodiments, the cup includes narrow portion or ledge that supports a portion of the food container and this narrow portion may also be utilized as a fill line when filling liquids into the cup, to ensure that insertion of the food container does not result in overflow of liquid from the cup.

2. Description of the Related Art

Standard cup lids are simple covers that do not include an integrated food container. Rather, known lids cover the contents of a cup wherein the lid forms a closed container in combination with the cup itself. Known containers that couple with cups include food containers that fit onto the top of yogurt cups for example. These containers typically have to be removed from the yogurt cup and then flipped over and opened before the contents of the container and cup may be accessed. It is generally not possible to access the contents of the cup while also accessing the contents of the container without first disengaging the container from the cup. Additionally, food containers that attach to yogurt cups, for example, in an upside-down position have a limited food-volume capacity. In such cases, as the yogurt example shows, the food-container walls narrow as they proceed upward toward the bottom of the upside down container. Other known devices having a container or shelf combined with a lid have limitations, which makes these devices impractical to use.

One category of devices typically includes a container combined with a cup, but utilizes a hole in the middle of the lid. This makes it generally impossible to store relatively circular items, i.e., non-ring or non-annular items having no central hole, in the container, such as hamburgers, cookies or muffins for example. Another category of device typically includes a container combined with a lid, but does not allow for simultaneous access of the contents of the cup and the container, and does not allow for the container to be resealed or a drop-in seated container to be inserted and removed from the food container. Other containers that form portions of the lid have limitations in the amount of storage or shape of the storage area, which limits the quantity or type of food respectively.

Thus simultaneous or intermittent access of the contents of known cups and of the contents of an attached container is not practical for at least the reasons listed above. This makes for difficult drinking/eating coffee, soda, snacks, popcorn, etc., in malls, fast food restaurants, theaters, amusement parks, and sports stadiums or in any other venue. In addition, this makes it difficult to eat and drink food in a theater or stadium with one cup-holder per seat, and makes it difficult to simultaneously access solids and liquids using a plurality of containers and container cavities, without disengaging the containers/cavities.

Generally, spill proof dual function food/drink containers have been developed for parents to provide their children with a snack and drink at the same time. These types of containers which supply a food container body that rests in the upper portion of a drink cup are, typically, thick-walled, injection molded, and reusable. Such containers are usually manufactured abroad and are relatively expensive to manufacture compared to thin film or thin wall disposable containers. Reusable containers may be disassembled such that the various parts may be placed in a dishwasher. Thick walled reusable containers may additionally employ parts that screw together and utilize "O" rings for a tight leak-proof seal.

Although thick walled, reusable, food/drink containers have been developed, skillfully engineered, thin film thermoformed or thin wall injection molded disposable containers have not been developed for the fast food and convenience store industries. Thin film thermoforming and thin wall injection molding are typically the two most cost efficient manufacturing methods for producing high volume parts. According to industry standards, thin film or thin wall construction is defined in the approximate range of 0.010 to 0.030.

Typically, thin film thermoforming and thin wall injection molding are specific manufacturing sciences that demand precise engineering and highly accurate tolerances. Strategic strength features or elements that stabilize the structural integrity of the cups and containers, generally, must be incorporated into the construction of thin wall parts. Without strength elements, thin wall parts generally become flimsy and lose their ability to precisely mate with one another. Typically, thin film thermoforming requires drafts on all parts such that the parts may release from their prospective molds. When it comes to thin film or thin wall construction, every detail is important. Without precise engineering, for example, thin wall parts may lack structural integrity and these parts may lose their ability to precisely fit together.

U.S. Pat. No. 4,074,827 to Labe et al., entitled "Multi-Purpose Closure for Containers", appears to disclose a straw that goes directly through the inner cavity that is formed between a base member and a top cover, where the straw directly interferes with the inner cavity that holds an article or food item. The reference appears to lack any mention of an outer diameter flange of an upper food container cover, and wherein the outer diameter flange of the upper food container body may include two horizontal cap wall surfaces which meet and become flush when the upper food container cover is placed on the upper food container body. In addition, the reference appears to lack any mention of an arched shaped straw notch that intersects the outer edge or a straw hole adjacent to the outer edge that occur in the flush horizontal cap wall surfaces that are integrated into the outer edge regions of the upper food container cover and upper food container body. Hence, embodiments that show a straw require that the straw be removed before removing the cover to access the contents of the container, hence Labe does not allow for simultaneous access of the contents of the cup and container. Furthermore, the device of Labe et al. appears to lack any mention of a food container with a plurality of cavities to hold solids and liquids and at least one independent drop-in container.

U.S. Pat. No. 7,217,434 to Loh et al., entitled "Condiment Dispenser for Beverage Container", appears to show a seal-on/peel-off cover sealing over a straw hole located adjacent to an outer diameter edge of a cylinder. The reference appears to lack any mention of tapered or drafted sidewalls due to the fact that a cylinder is a tube like structure that has straight or parallel sidewalls. In addition, using the device of Loh, before a straw can be inserted, it appears as though the seal-on/peel-off layer must be removed, since a straw notch or straw hole is not present at the outer edge of the cylinder or cylinder cover. Loh discloses wherein the seal-on/peel-off layer is adhesively adhered to the top edge of the cylinder, and wherein the seal-on/peel-off cover is flat thus restricting the height of food items that may be placed within the cylinder from proceeding above the rim of the cylinder. Loh appears to lack any mention of a domed upper food container cover or variable height domed cover that is replaceable, that allows for a wider variety of foods of various heights to be placed within the upper food container and reduces the depth requirement of the food cavity thus making it easier to reach in and grab food that is contained within the cavity. Loh is silent to resealing the container once the straw is inserted as well. Furthermore, the device of Loh appears to lack any mention of a food container with a plurality of cavities to hold solids and liquids and at least one independent drop-in container.

United States Patent Publication 20030089725 to Kang, entitled "Double Cup Separable Into Upper and Lower Sections", appears to disclose an auxiliary cup with a hole through the bottom that may allow liquid to enter the food volume cavity of the auxiliary cup. In addition, Kang appears to show a guide rod through which a straw may pass to prevent food within the auxiliary cup from getting wet. However, the guide rod and straw appear to be centrally located which prevents a large food item or items from being placed within the auxiliary cup. Furthermore, Kang appears to show a cup with no structural support in the top edge of the up, and the cup may only be injection molded and utilized with a thick wall construction. The straw space as shown in the reference appears to be extremely large which increases the possibility that liquid will escape when the cup is tilted as the user is drinking from the cup. Additionally, it appears as though Kang lacks any mention of a straw notch or straw hole that may be placed in the top cover. Kang also describes an auxiliary cup that has no top edge or stopper thus making it difficult for the cover to attach to a cup lip that has no top edge. Furthermore, the device of Kang appears to lack any mention of a food container with a plurality of cavities that may hold solids and liquids and at least one independent drop-in container.

United States Patent Publication 20110094904, to Lee, entitled "Container for Food and Beverage", appears to show that a straw cannot be installed in the main body of the container, sub-receiving cavity or the spouting portion until the thin seal layers are removed from the sub container body and the spouting hole. Removing the thin seal layers prior to using the device of Lee, for example, complicates the process of accessing the food and beverage contained within the main body and the sub-receiving cavity. Additionally, Lee appears to disclose wherein the sub-receiving cavity is tightly coupled to the main body, which further complicates the process of removing the sub-receiving cavity when refilling the main body with a liquid or beverage. Furthermore, the sub-receiving cavity and the sub container, of Lee, appear to be sealed by a seal member such as aluminum foil, and the seal member is designed to reseal. However, the seal member, for example, does not appear to include a thermoformed or injection molded snap-on or press-fit cover that includes an arch shaped straw notch or cut out that proceeds around the location of a straw or a pre-formed or pre-cut straw hole through which a straw may proceed to the contents of the main body or beverage cup. Furthermore, the device of Lee appears to lack any mention of a food container with a plurality of cavities that may hold solids and liquids and at least one independent drop-in container.

U.S. Pat. No. 2,740,575, to Fontaine, entitled "Dispensing Container" appears to disclose an inner container with a flat peripheral flange that is secured in a downwardly located annular grove located near the upper edge region of an outer cup. As such, the device of Fontaine makes it difficult to reach down into the cup to grip the edge of the inner container to remove it from the outer cup in order to refill the cup with a beverage or liquid. Additionally, using the device of Fontaine, it appears as though a straw cannot be inserted into the opening adjacent to the inner container until the top cover has been removed. The top cover appears to be flat which limits the height of food items that may be placed within the inner cavity. The device of Fontaine appears to lack any mention of a food container with a plurality of cavities that may hold solids and liquids and at least one independent drop-in container, and an upper food container cover that includes a simple domed or variable height domed cover.

Furthermore, there are no known devices that relate to an upper food container body that rests in the upper portion of a drink cup that demonstrates an inward arched or planar indent that intersects the outer substantially vertical sidewall of both the upper dome shaped food container cover and upper food container body where both inward indents are perpendicularly intersected by a horizontal cap wall that employs an arch shaped straw notch or straw hole and where both horizontal cap walls meet and become flush with one another when the cover is placed on the food container body and where additionally both flush cap walls form a double wall liquid retention barrier that surrounds the location of where the straw enters the arch shaped straw notch or straw hole.

In addition, no known devices show an inverted structural trough element integrated into an outer edge area of an upper food container body, where the inverted trough element may additionally acts as a spill retention barrier wall as well as providing a vertically oriented receiving wall that meets the small horizontally oriented flexible flange/lip of the upper dome shaped food container cover. Furthermore, no known devices demonstrate an upper dome shaped food container cover that employs a small horizontally oriented flexible flange/lip that rapidly snaps past one or more continuous or non-continuous male snap/bump elements that are integrated into the vertically oriented receiving wall of the inverted structural trough element that is part of the upper food container body.

No known devices disclose a thin wall upper dome shaped food container cover that employs an inward arched or planar indent that is perpendicularly intersected by a horizontal cap wall that employs an arch shaped straw notch that intersects an outside curved edge of the horizontal cap wall, wherein the straw notch allows the cover to be removed from the food container body without disturbing the orientation of the straw, such that the straw maintains its original position within the cup. Generally, an arch shaped straw notch may only be utilized when the upper food container cover snaps to the vertically oriented receiving wall of the inverted structural trough element. If the cover snaps to the exterior wall of inverted structural trough element, then it may be necessary to employ a straw hole due to the specific requirements of die cutting procedures.

Generally, known devices lack a food container body that rests in the upper portion of a cup and includes one or more dividing walls that form one or more downward oriented food cavities within the upper food container body. Furthermore, known devices typically lack a downward sauce or condiment cavity that may receive a prefilled condiment container located adjacent to a food cavity in order to facilitate the convenience of close proximity dipping. In addition, no known devices include two symmetrical sauce or condiment cavities located within the upper food container body, wherein the two prefilled drop-in sauce or condiment containers may be easily oriented as they are dropped into the symmetrical cavities.

Typically, no known devices show interchangeable upper food container bodies that may employ one or more downward food or sauce cavities that may vary in depth in relation to one another, wherein each of the different and unique food container bodies may fit into the upper region of a same size drink cup. Furthermore, typical devices appear to lack a disclosure of an upper dome shaped food container cover that may be configured according to the various height requirements of various foods, such that the various height food container covers may be interchanged with the various food container bodies that fit within the upper region of the same size drink cup.

Generally, no known devices use an independent drop-in food container with a replaceable press-on cover, such that the upper food container body may include a microwaveable, independent drop-in food container with a replaceable interior wall or exterior wall press-on cover. In addition, no known devices include an upper food container body with a downward food cavity that may receive an independent drop-in food container, and one or more downward arch shaped finger grab indents adjacent to the downward food cavity that may facilitate easy lifting and removal of the independent drop-in food container from the downward food cavity.

Typically, known devices appear to lack an upper dome shaped food container cover that additionally includes a downward cavity of any size or shape in the top horizontal wall of the variable height dome shaped cover that may hold one or more additional sauce or condiment containers, small cookies, candy, toys, utensils or promotional items. Furthermore, known devices generally lack any disclosure of an additional downward cavity in the top horizontal wall of the variable height dome shaped food container cover that may include a replaceable interior wall or exterior wall snap-on or press-fit cover that may contain the contents of the downward cavity.

For at least the limitations described above there is a need for a cup with nestable food container and cover wherein the container includes at least one or a plurality of downward oriented container cavities.

BRIEF SUMMARY OF THE INVENTION

One or more embodiments described in the specification are related to a cup with nestable food container and cover wherein the food container nests in the upper region of a cup. In at least one embodiment of the invention, the food container includes at least one wall that defines at least one container body and at least one or a plurality of downward oriented cavities, wherein the at least one container body stores food including a first solid or liquid. For example, in one embodiment, the food container may also include one wall that defines at least one container body and one downward oriented cavity. In embodiments, the at least one container body may include an outer edge area, and a plurality of downward oriented cavities for example include a bottom outer portion, such as, but not limited to a corner portion. In at least one embodiment, the corner portion may rest on a corner portion that is integrated into the sidewall of the cup for example to support the food container. In other embodiments any portion of the container may rest on the cup alone or in combination, include on the upper lip, strength portions of the cup or any other area of the cup.

According to at least one embodiment, the cup includes a substantially vertical sidewall and an annular opening for example that may lie or reside in an annular plane on top of the cup. In one or more embodiments, the substantially vertical sidewall includes a lower cup body, and an upper cup body having a portion that is wider than the lower cup body. In at least one embodiment, at the location where the upper cup body transitions into the lower cup body there is a portion, for example a point, line or series of lines, piecewise continuous, slanted, angled, curved or other any other shape, for example a continuous outer corner portion that defines a fill line which indicates the volume of beverage to place in the cup. The corner portion of the upper cup body that forms the fill line may also be utilized as a support for the food container.

By way of at least one embodiment, the at least one container body contacts the first solid or liquid on one side and the second solid or liquid on an opposing side of the at least one wall. In one or more embodiments, the upper cup body holds the food container, and the at least one container body may descend into the annular opening of the cup and down into the portion that is wider than the lower cup body. In at least one embodiment, the bottom corner portion of the at least one of the plurality of downward oriented cavities may rest on the continuous outer corner portion that defines the fill line. In other embodiments, any portion of the container may rest on or otherwise be supported by any portion of the cup.

In one or more embodiments of the invention, the at least one container body may include at least one dividing wall defining the plurality of downward oriented container cavities to hold the first solid or liquid. According to one or more embodiments, the at least one container body may include a plurality of container bodies, wherein the plurality of container bodies each include the plurality of downward oriented container cavities, and the plurality of downward oriented container cavities may each vary in size, shape and depth.

According to at least one embodiment, the food container includes at least one cover, such as a single cover or a plurality of covers, to enclose at least a portion of the food container. In at least one embodiment, the food container and the at least one cover together may be a one-piece element, or may be separate elements. In one or more embodiments, the plurality of covers may vary in one or more of height and shape. In at least one embodiment, the at least one cover, or plurality of covers, includes at least one downward oriented cover cavity. In one or more embodiments, the at least one downward oriented cover cavity may include at least one replaceable snap-on or press-fit cover. In at least one embodiment, the at least one replaceable snap-on or press-fit covers may include an upward vertically oriented handle.

In one or more embodiments of the invention, at least one downward oriented container cavity of the plurality of downward oriented container cavities may receive an independent drop-in container that may employ an independent drop-in container cover. In at least one embodiment, the independent drop-in container and the independent drop-in container cover are microwavable.

By way of at least one embodiment, the at least one container body may include a first inward arched or planar indent, and the at least one cover may include a second inward arched or planar indent. In one or more embodiments, the at least one cover and the at least one container body may include a substantially vertical sidewall, such that both the first inward arched or planar indent and the second inward arched or planar indent intersect the substantially vertical sidewalls of the at least one cover and the at least one container body. In one or more embodiments, the first inward arched or planar indent may be configured as an inverted trough dividing wall that travels diagonally across the width of the at least one container body.

In at least one embodiment, the first and second inward arched or planar indents that intersect the substantially vertical sidewall of the at least one container body and the at least one container cover are intersected at a predefined angle, for example perpendicularly intersected by a first horizontal cap wall (respectively) and a second horizontal cap wall, or at any other desired angle.

According to one or more embodiments, the first and second horizontal cap walls include a straw notch or straw hole to accept a straw. In at least one embodiment, the first and second horizontal cap walls may meet and be flush with one another when the at least one cover is placed on the at least one container body. As such, in at least one embodiment, the flush horizontal cap walls form a double wall liquid retention barrier to surround a location of where the straw enters the straw notch or straw hole.

In one or more embodiments, the outer edge area of the at least one container body includes an inverted structural trough element, that acts as an integrated coupling element that allows the at least one cover to couple to the at least one container body. In at least one embodiment of the invention, the at least one cover may include at least one horizontally oriented flexible flange/lip located at the outer edge. According to one or more embodiments, the integrated coupling element that may be configured as an inverted structural trough element may include an inner vertical wall surface that may include at least one male snap/bump element. As such, in at least one embodiment, the at least one horizontally oriented flexible flange/lip of the at least one cover may snap over the at least one male snap/bump element. Any number of snap elements may be utilized in keeping with the spirit of the invention.

By way of at least one embodiment, the integrated coupling element or inverted structural trough element may reside above the annular plane formed by the rim of the cup. In one or more embodiments, the integrated coupling element or inverted structural trough element may be or act as a spill retention barrier wall.

In at least one embodiment, the cup may include a rolled rim with a top surface, wherein the integrated coupling element or inverted structural trough element may reside directly over and touch the top surface of the rolled rim. In one or more embodiments, the integrated coupling element or inverted structural trough element may be secured in an elevated position above the annular plane formed by the rim of the cup, such that the elevated position allows the straw to enter the arched or planar indent that may be configured as an inverted trough dividing wall that may travel diagonally across the width of the at least one container body. In the embodiment that includes an inverted trough dividing wall, the straw may diagonally enter the inverted trough dividing wall such that an inward arched or planer indent, or horizontal cap wall, and a straw notch or straw hole, are not required in the at least one cover.

According to at least one embodiment, the substantially vertical sidewall of the cup may include at least one horizontal step wall or strength rib element integrated into the upper region of the upper cup body. The at least one cover may include at least one horizontal step wall or strength rib element that is integrated into the lower region of the substantially vertical sidewall of the at least one cover. In one or more embodiments, the at least one cover may include a grip handle and at least one vent hole. The at least one vent hole, in at least one embodiment, may prevent condensation from building up within the at least one cover and the at least one container body.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A cup with nestable food container and cover, for example a cup with an upper cup body that receives at least one food container body that may include at least one or a plurality of downward oriented cavities and at least one container cover will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
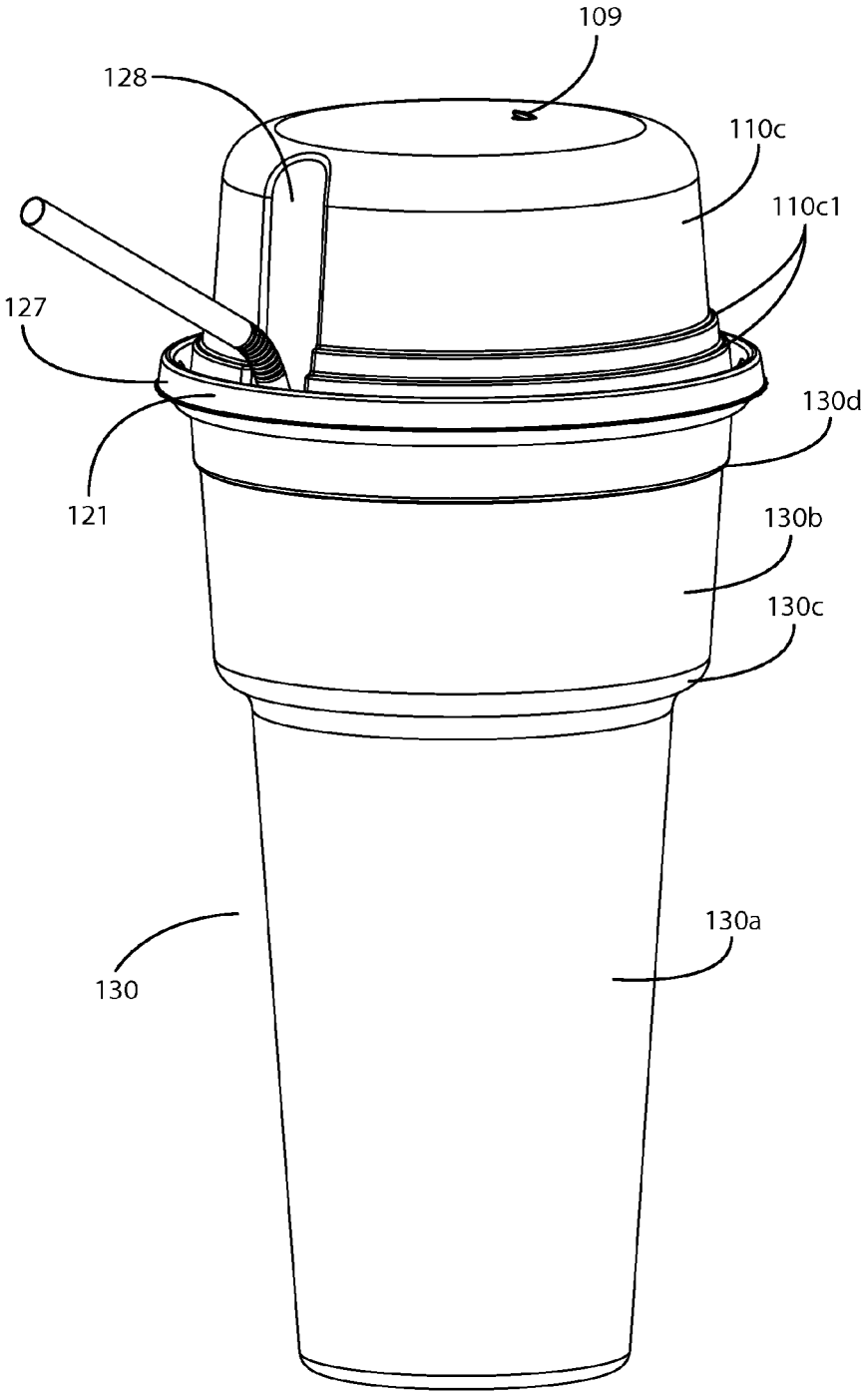
FIG. 1 illustrates a perspective view of at least one embodiment of the invention.
Figure 2:
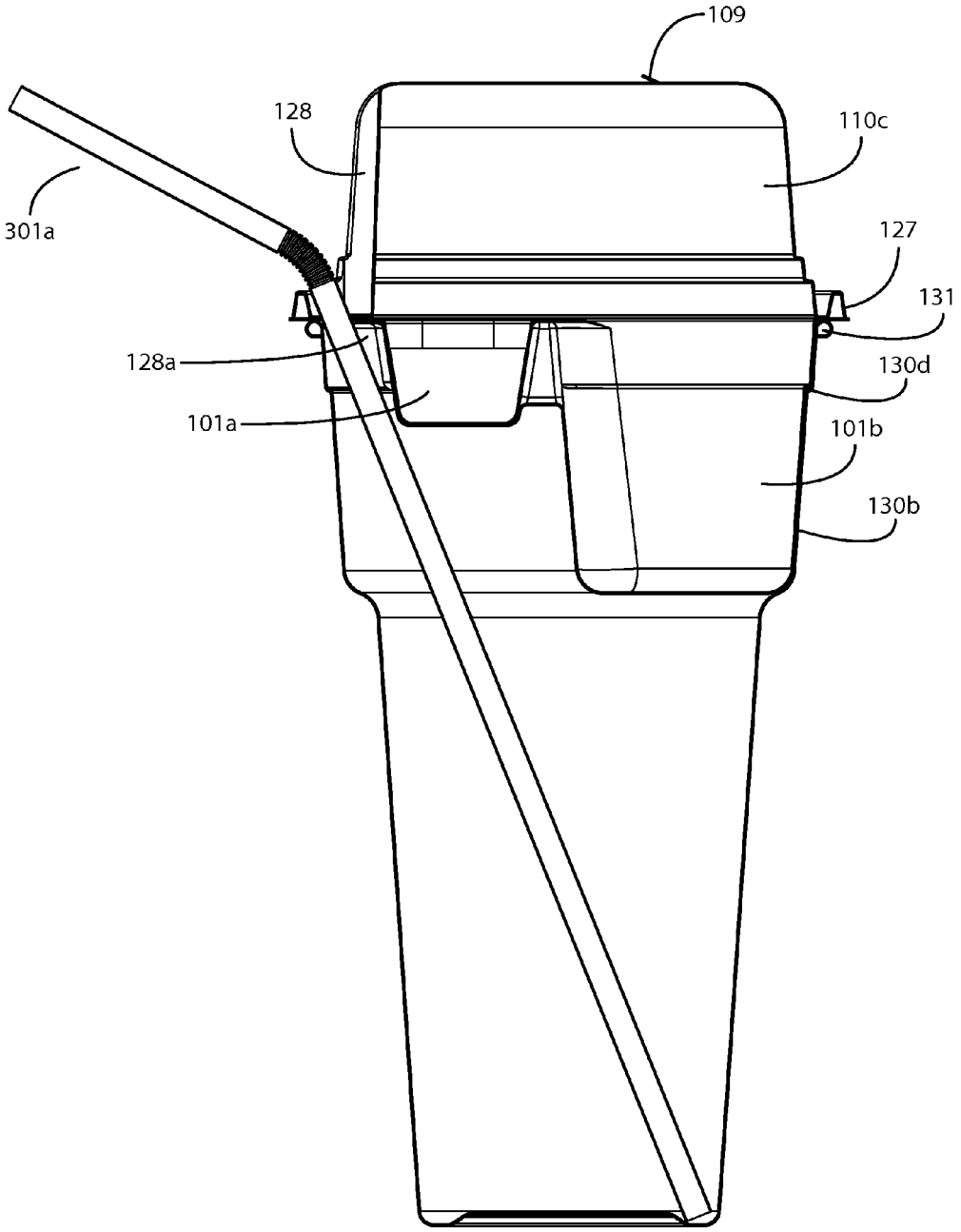
FIG. 2 illustrates a side cutaway view of at least one embodiment of the invention.
Figure 3:
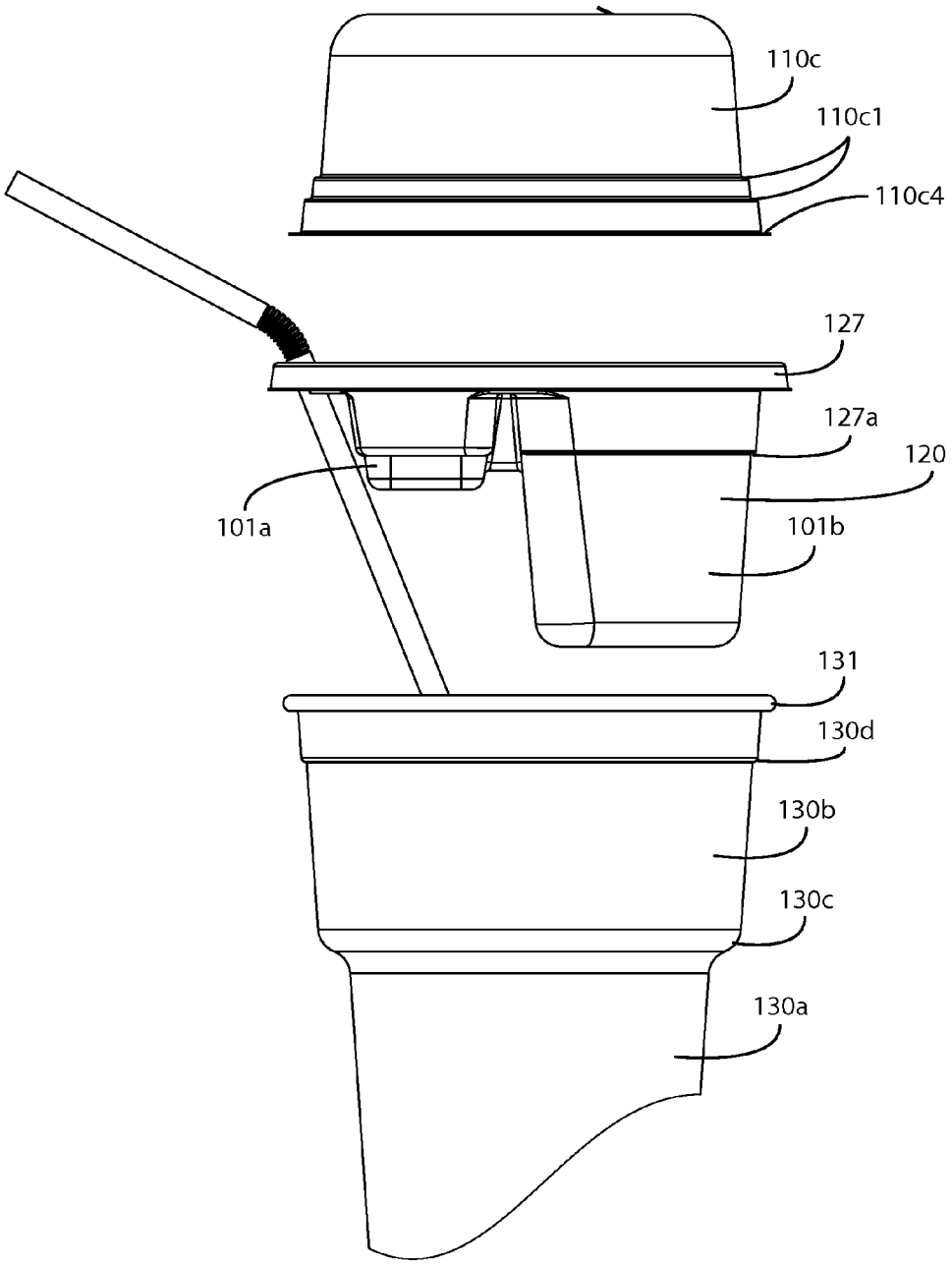
FIG. 3 illustrates an exploded side view of at least one embodiment of the invention.

Referring to FIGS. 1-3, specific elements as shown will now be described. FIG. 1 illustrates a perspective view of at least one embodiment of the invention. As shown in FIG. 1, one or more embodiments described in the specification are related to cover 110*c*, a food container 120 (see FIG. 3) and a cup 130. As shown, according to at least one embodiment of the invention, the food container 120 and cup 130 may include at least one cover 110*c*, at least one cover vent hole 109, a second inward arched or planar indent 128 in the at least one cover 110*c*, and at least one horizontal step wall or strength rib element 110*c*1 in cover 110*c*. In at least one embodiment, the food container 120 (see FIGS. 2 and 3) may include an inverted structural trough element 127 that may act as an integrated coupling element 121, although in other embodiments the inverted structural trough element 127 may form part of the cover. A portion of which may be configured to enable the cover to couple with the food container and optionally couple the food container with the cup, wherein either coupling may be implemented as a resting or snap type coupling or any other coupling type. The upper cup body 130*b* may include at least one horizontal step wall or strength rib cup elements 130*d*.

In at least one embodiment, the cup 130 includes a substantially vertical sidewall and an annular opening defined by the rim 131 (see FIG. 2) of the cup 130. In one or more embodiments, the rim 131 of the cup 130 for example, may or may not include a rolled edge. In one or more embodiments, the substantially vertical sidewall includes a lower cup body 130*a*, and an upper cup body 130*b* having a portion that is wider than the lower cup body 130*a*. In at least one embodiment, at the location where the upper cup body 130*b* transitions into the lower cup body 130*a*, there is a portion, for example a continuous outer corner portion that defines a fill line 130*c*, which indicates the volume of beverage to place in the cup 130. The portion that defines the fill line 130*c* may be of any size or shape, for example as shown the continuous outer corner portion of the upper cup body 130*b* and may also be utilized as a support for the food container (see FIG. 2). Alternatively, or in combination with the support provided at least a portion of the fill line, the at least one horizontal step wall or strength rib cup elements 130*d* may support a corresponding ledge, flange, narrowing portion or any other shape on the food container. In one or more embodiments, either or both support areas may be utilized to provide support to the food container.

According to at least one embodiment, the food container includes at least one cover 110*c*, to enclose the at least one food container 120. In at least one embodiment, the at least one food container 120 and the at least one cover 110*c* may be configured as a one-piece clamshell construction, or may be separate elements as shown. In one or more embodiments, the at least one cover 110*c* may vary in height or shape. In one or more embodiment, the at least one cover 110*c* may be configured as a raised dome shaped cover.

According to at least one embodiment, the substantially vertical sidewall of the cup 130 may include the at least one horizontal step wall or strength rib cup element 130*d* integrated into the upper cup body 130*b*. In one or more embodiments, the at least one cover 110*d* may include an upward vertically oriented handle 701 (see FIG. 7) and at least one vent hole 109. The at least one vent hole 109, in at least one embodiment, may prevent condensation from building up within the at least one cover 110*c* and the at least one container body 120. According to one or more embodiments, the at least one vent hole 109 may be located on a top surface wall of the at least one cover 110*c*. As such, in at least one embodiment, when steam builds up on the inside of the at least one cover 110*c*, and at least one container body 120, water drops are prevented from dripping downward from the interior of the at least one cover 110*c*, which would result in food items that get soft or soggy.

FIG. 3 illustrates an exploded side view of at least one embodiment of the invention. One or more embodiments include at least one horizontal step wall or strength rib cup element 130*d* that is integrated into the sidewall of the upper cup body 130*b*. The at least one horizontal step wall or strength element 130*d* may act as a mating element that seats or engages the at least one horizontal step wall or strength rib cup element 127*a* that is integrated into the substantially vertical sidewall of the at least one container body 120.

FIG. 2 illustrates a side view of at least one embodiment of the invention. In at least one embodiment of the invention, the food container includes at least one wall that defines at least one container body 120 (shown in FIG. 3) and a plurality of downward oriented container cavities 101*a* and 101*b*, wherein the at least one container body 120 stores food including a first solid or liquid, as will be discussed further below. In one or more embodiments, the at least one container body 120 includes a plurality of downward oriented container cavities 101*a* and 101*b* which include a bottom outer portion, such as a corner portion. In at least one embodiment, the corner portion may engage with the continuous outer corner portion that is located in the sidewall of the cup 130 for example to support the food container.

By way of at least one embodiment, the at least one container body 120 may include a first inward arched or planar indent 128*a*, and the at least one cover 110*c* may include the second inward arched or planar indent 128. In one or more embodiments, each of the at least one cover 110*c* and the at least one container body 120 may include a substantially vertical sidewall, such that both the first inward arched or planar indent 128*a* and the second inward arched or planar indent 128 intersect the substantially vertical sidewalls of the at least one cover 110*c* and the at least one container body 120. In one or more embodiments, the first inward arched or planar indent 128*a* may be configured as an inverted trough dividing wall that travels diagonally across the width of the at least one container body 120.

In one or more embodiments, the at least one container body 120 may be divided into at least two cavities that reside on either side of the inverted trough dividing wall or inward arched or planar indent 128*a*. In at least one embodiment (see FIG. 6-*bottom* configuration), the straw 301*a* may diagonally enter the cup via the inverted trough dividing wall when the at least one container body 120 is secured in an elevated position above the annular horizontal plane that is formed by the rim 131 of the upper cup body 130*b*, as will be discussed further below. By way of at least one embodiment, the at least one container body 120 may be secured in an elevated position via tapered wall surface to surface contact and/or using the at least one horizontal step wall or strength rib cup element 130*d* or the bottom outer corner engagement at the fill line 130*c*. As will be discussed further below regarding FIG. 6, the straw 301*a* may enter the cup 130 via the first inward arched or planar indent 128*a* or the inverted trough dividing wall which may or may not be perpendicularly intersected by a horizontal cap wall, as long as the at least one container body 120 is secured in an elevated position above the annular horizontal plane formed by the rim 131 of the cup 130.

By way of at least one embodiment, the at least one container body 120 contacts the first solid or liquid on one side and the second solid or liquid on an opposing side of the at least one wall. In one or more embodiments, the upper cup body 130*b* holds the food container, and the at least one container body 120 (see FIG. 3) may descend into the annular opening of the cup 130 and down into the wider portion of the upper cup body 130*b*. In at least one embodiment, the bottom corner portion of the at least one of the plurality of downward oriented cavities of the container body 120 may rest upon the continuous outer corner portion that is integrated into the substantially vertical sidewall of the upper cup body 130*b*. In one or more embodiments of the invention, the food container body 120 and food container cover 110*c* may include a straw hole or straw notch to accept a straw 301*a*, as will be discussed further below with respect to FIG. 4.

According to at least one embodiment of the invention, the cup 130 and may include an insulation layer that may float on top of the second solid or liquid in the cup 130. For example, the floating insulation layer may be useful when the second solid or liquid may include a cold item. In one or more embodiments, the insulation layer, that may be a floating insulation layer, may be a substantially circular layer that may be die-cut. In at least one embodiment, the insulation layer may be die-cut from a thin sheet of closed cell foam or bubble-wrap, or any other insulative material in keeping with the scope of the invention. According to one or more embodiments, the insulation layer may include any type of cut out through the insulation layer, wherein the cut out may intersect an outer diameter edge of the insulation layer, such that a straw, such as straw 301*a*, may access the solid or liquid in the cup 130.

As shown in FIG. 3, in one or more embodiments, the outer edge area of the at least one container body 120 includes an inverted structural trough element 127, that may act as an integrated coupling element 121, that couples the at least one cover 110*c* to the at least one container body 120. In one or more embodiments, the inverted structural trough element 127, and/or the integrated coupling element 121, may engage with the outer edge of the horizontally oriented flexible flange/lip 110*c*4. Adjacent to the inner substantially vertical sidewall of the inverted structural trough element 127 or integrated coupling element 121, there is a small horizontal ledge that may rest on the top surface of the rolled rim of the cup 131. In other embodiments the inverted structural trough element 127 may press fit or snap onto the rolled rim of the cup 131. In one or more embodiments, the at least one container body 120 may include at least one horizontal step wall or strength rib element in the substantially vertical sidewall of container 120. In at least one embodiment of the invention, the at least one cover 110*c* may include at least one horizontal step wall or strength rib element 110*c*1 in the substantially vertical sidewall of the cover 110*c*. A horizontally oriented flexible flange/lip 110*c*4 is located at the outer edge of the at least one cover 110*c*. By way of at least one embodiment, the integrated coupling element 121, and/or the inverted structural trough element 127, again may reside above the annular plane formed by a rolled rim of the cup 130 (as will be discussed further below). In one or more embodiments, the integrated coupling element 121 and/or the structural trough element 127 may be or act as a spill retention barrier wall.

Figure 4:
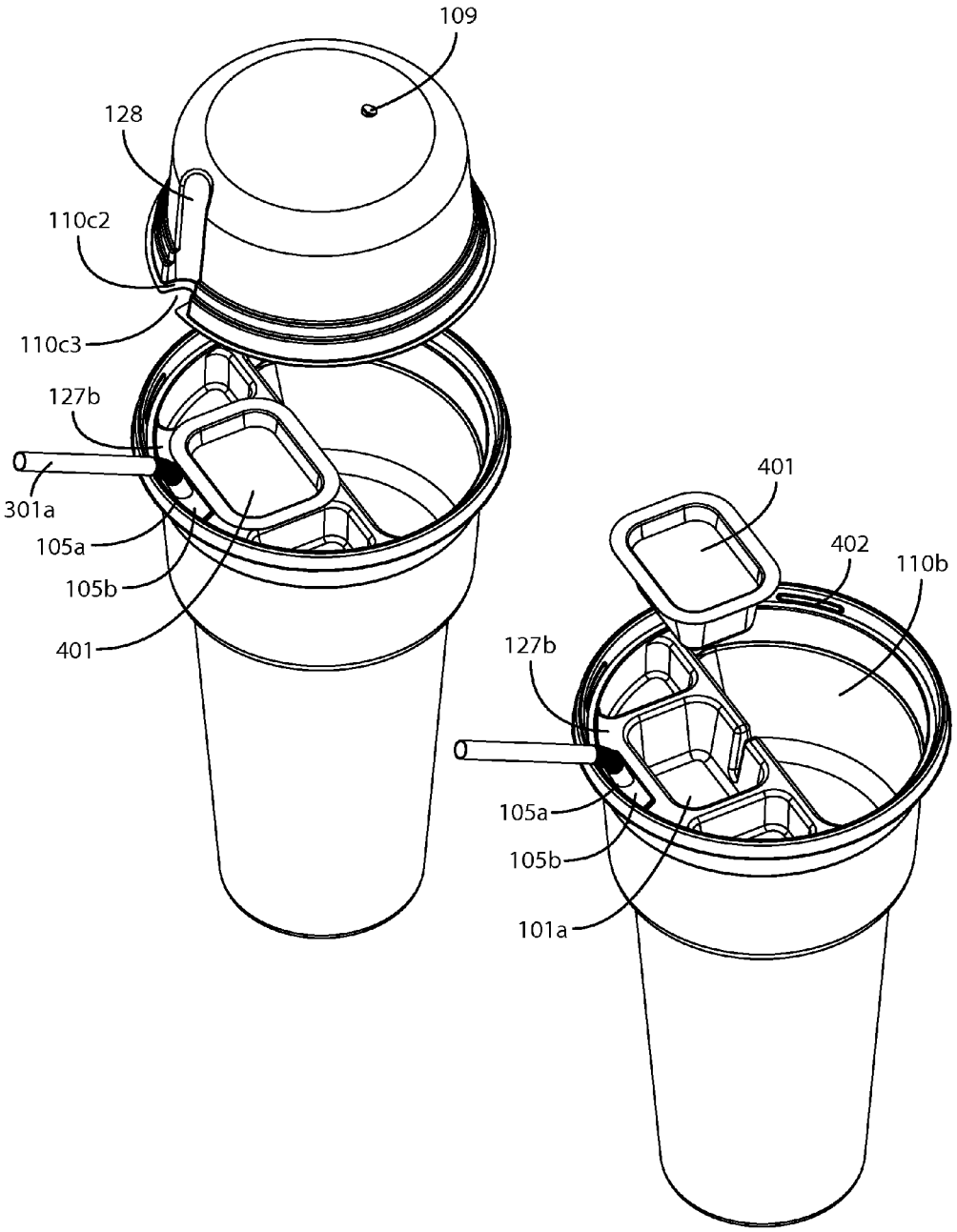
FIG. 4 illustrates an exploded perspective view of at least one embodiment of the invention with a plurality of downward oriented container cavities with the cover elevated in the upper left portion of the figure and with the cover removed, and with at least one independent drop-in container shown above the cavity that is configured to hold the drop-in container in the lower right portion of the figure.

FIG. 4 illustrates an exploded perspective view of at least one embodiment of the invention with a plurality of downward oriented container cavities with the cover elevated and with the cover removed, and with at least one independent drop-in container. As shown in FIG. 4, in one or more embodiments of the invention, the at least one container body 120 may include at least one dividing wall defining the plurality of downward oriented container cavities 101*a* and 101*b*, to hold the first solid or liquid. According to one or more embodiments, the at least one container body 120 may include a plurality of downward oriented container cavities 101*a* and 101*b*, and the container cavities 101*a* and 101*b* may vary in size, shape and depth. The container cavity 101*a* may receive an independent drop-in condiment container 401. Due to the location of the condiment cavity 101*a*, for example, which is located at the front edge of the embodiment in relation to the straw 131*a* and straw hole 105*a*, and due to the shallow depth of the condiment cavity 101*a* in relation to the larger food container cavity 110*b*, the straw 131*a* may diagonally enter the cup 130 without interfering with the bottom horizontal wall or outer bottom corner of the downward oriented condiment cavity 101*a*.

In one or more embodiments of the invention, at least one downward oriented container cavity of the plurality of downward oriented container cavities 101*a* and 101*b* may receive at least one independent drop-in container 401 with an independent drop-in container cover (not shown). In at least one embodiment, the independent drop-in container 401 and the independent drop-in container cover (not shown) are microwavable.

In at least one embodiment, the at least one cover 110*c* may include a horizontally oriented flexible flange/lip 110*c*4 at the outer edge of the cover 110*c*. In at least one embodiment, the first and second inward arched or planar indents 128*a* and 128 are perpendicularly intersected by the horizontal cap wall 110*c*2 and the second horizontal cap wall 105*b*.

According to one or more embodiments, the integrated coupling element 121 may include at least one male snap/bump element 402 integrated into the inner surface of the integrated coupling element 121. As such, in at least one embodiment, the horizontally oriented flexible flange/lip 110*c*4 may snap over the at least one male snap/bump element 402.

According to one or more embodiments, the horizontal cap walls 110*c*2 and 105*b* may include a straw notch 110*c*3 or straw hole 105*a* to accept the straw 301*a*. In at least one embodiment, the horizontal cap walls 110*c*2 and 105*b* may meet and be flush with one another when the at least one cover 110*c* is placed on the at least one container body 120. As such, in at least one embodiment, the flush horizontal cap walls 110*c*2 and 105*b* form a double wall liquid retention barrier to surround the location where the straw 301*a* enters the straw notch 110*c*3 and straw hole 105*a*. In one or more embodiments, the container may include a recessed top horizontal wall 127*b*.

In at least one embodiment, the recessed top horizontal wall 127*b* may be recessed in an area located adjacent to the straw hole 105*a*. According to one or more embodiments the recessed area defined by the recessed top horizontal wall 127*b* is recessed to accommodate the horizontal flange or lip of the at least one independent drop-in container 401 or independent drop-in containers 401*a* (of FIG. 5, discussed below) that may be placed in the at least one downward oriented container cavity 101*a* or cavities 401*b*. In at least one embodiment, the recessed top horizontal wall 127*b* insures there is no interference from the horizontal flange or lip of the independent drop-in containers 401 and 401*a* when the at least at least one container cover 110*c* is coupled to the at least one food container body 120. The recessed top horizontal wall 127*b* allows the horizontal cap wall element 110*c*2 to become flush with the horizontal cap wall element 105*a* when the at least one cover 110*c* is coupled to the at least one food container body 120. When the horizontal cap wall elements 110*c*2 and 105*a* become flush, a double wall liquid retention barrier is formed around the location of where the straw 103*a* enters the straw notch 110*c*2 and straw hole 105*a*.

Figure 5:
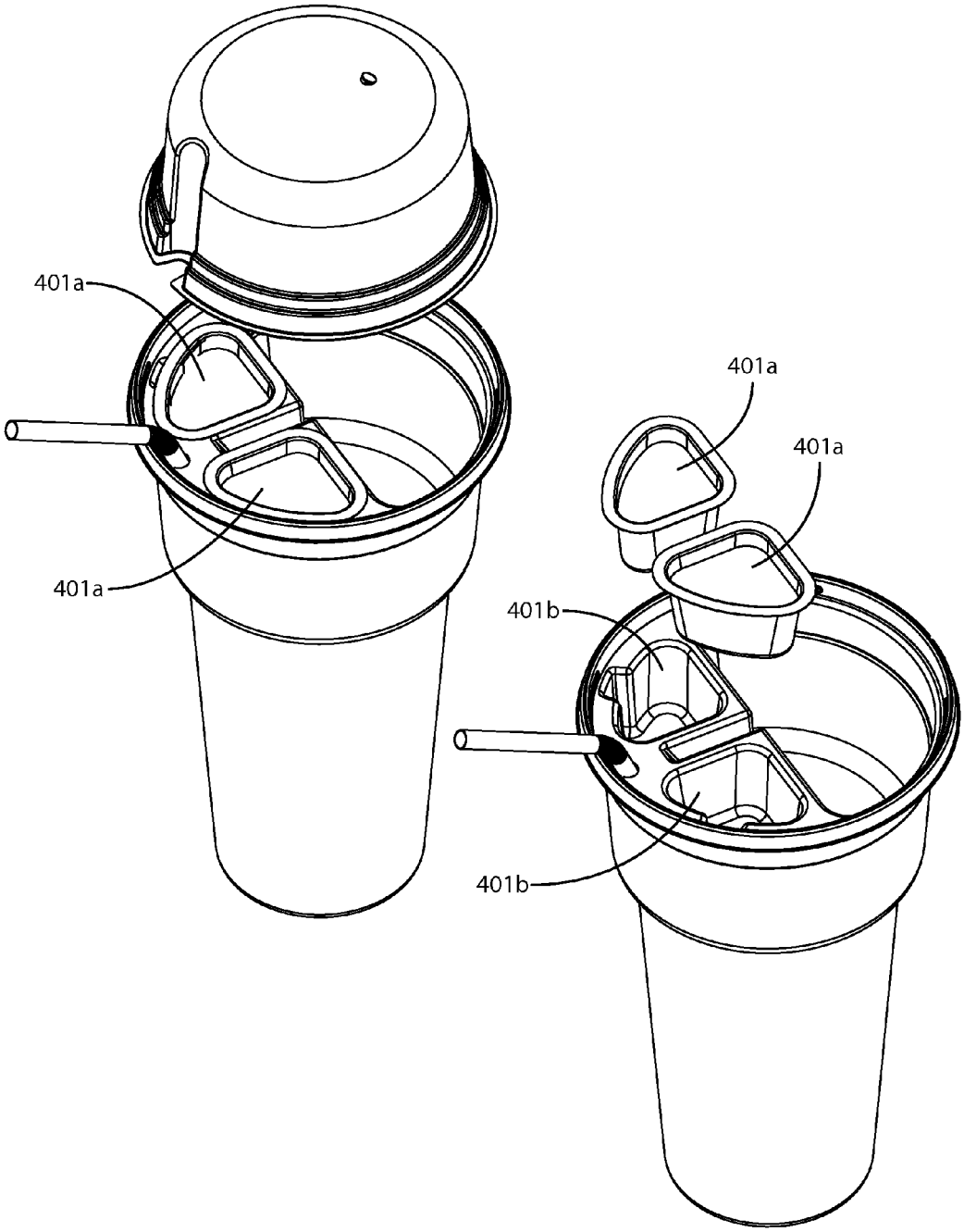
FIG. 5 illustrates an exploded perspective view of at least one embodiment of the invention with a plurality of downward oriented container cavities with the cover elevated in the upper left portion of the figure and with the cover removed, and with at least one independent drop-in container shown above respective cavities configured to hold the at least one drop-in container in the lower right portion of the figure.

FIG. 5 illustrates an exploded perspective view of at least one embodiment of the invention with a plurality of downward oriented container cavities with the cover elevated and with the cover removed, and with at least one independent drop-in container. As shown, by way of one or more embodiments of the invention, the plurality of downward oriented container cavities may be configured to include container cavities 401*b* that may receive a plurality of independent drop-in containers 401*a* with independent drop-in container covers (not shown). In at least one embodiment, the independent drop-in containers 401*a* may be symmetrical, which makes it easy to orient the independent drop-in containers 401*a* within the container cavities 401*b*.

Figure 6:
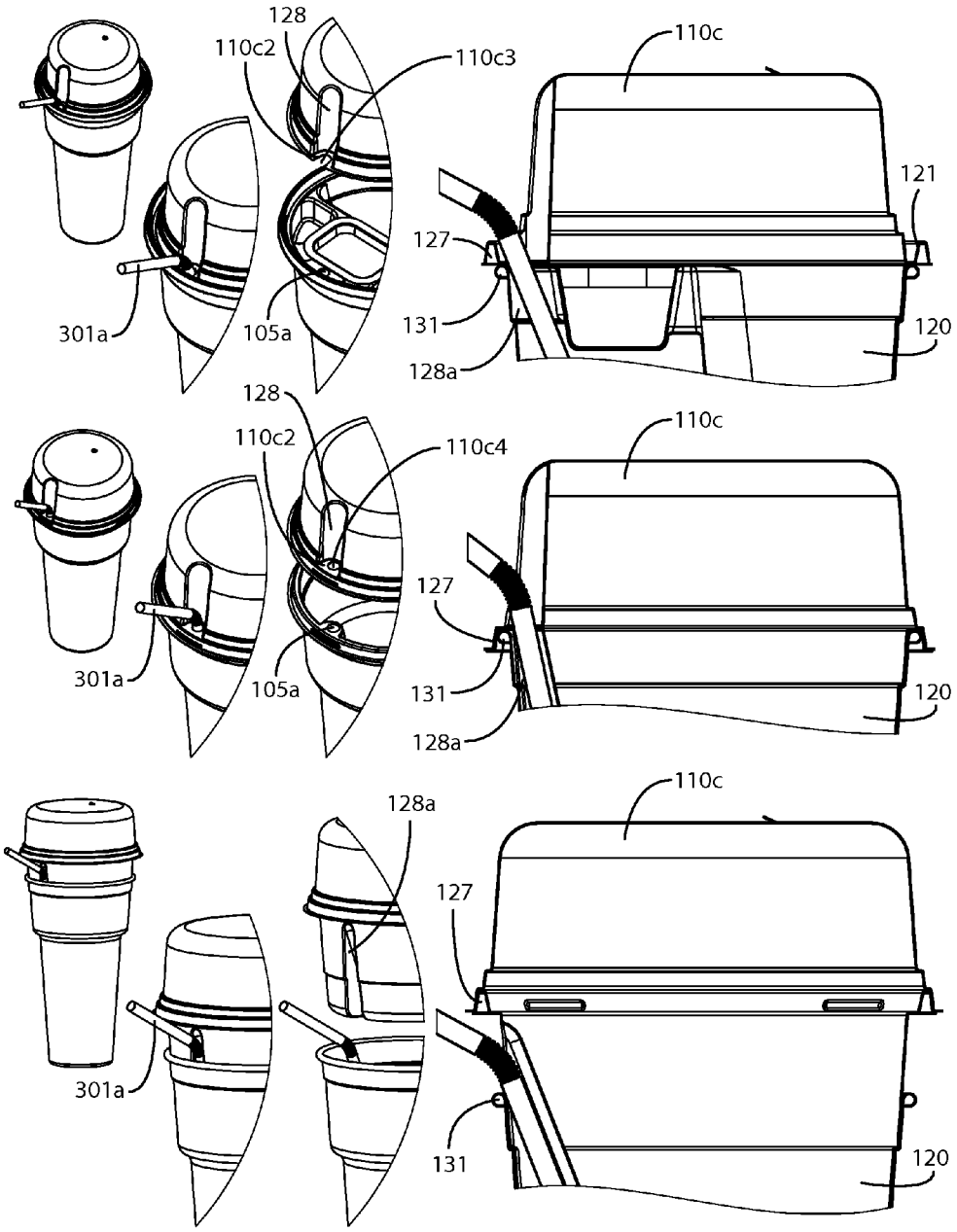
FIG. 6 illustrates several side and perspective views of three embodiments of the invention that include the first and second inward arched or planar indents.

FIG. 6 illustrates several side and perspective views of three embodiments of the invention with first and second inward arched or planar indents. As shown, in at least one embodiment, the cup 130 may include a rolled rim 131 with a top surface, wherein the inverted structural trough element 127 that may act as an integrated coupling element 121 may reside directly over and touch the top surface of the rolled rim 131 of cup 130. In one or more embodiments, the inverted structural trough element 127 may be located in an elevated position above the annular plane formed by the rim 131 of the cup 130, such that the elevated position allows the straw to traverse or enter the side of the at least one container body 120 without an indent or horizontal cap wall in the cover as shown in the bottom embodiment.

In one or more embodiments, the at least one container body 120 and the at least one cover 110*c* may both employ an inward arched or planar indent 128*a* and 128, that intersect the substantially vertical sidewall of both the at least one container body 120 and the at least one cover 110*c*. As such, in one or more embodiments, utilizing the second inward arched or planar indent 128 that intersects the substantially vertical sidewall of at least one cover 110*c* allows for the use of a straw 301*a* and straw notch 110*c*3 in the domed shaped cover 110*c*.

In at least one embodiment, the arched or planar indents 128*a* and 128 are perpendicularly intersected by the horizontal cap walls 110*c*2 and 105*b*. The horizontal cap wall 110*c*2 is integrated into the horizontally oriented flexible flange/lip 110*c*4 of cover 110*c*. The horizontal cap wall 110*c*2, of the cover 110*c*, in at least one embodiment, may include an arched shaped straw notch 110*c*3, located near the second inward arched or planar indent 128 that intersects the outer diameter edge of the horizontal cap wall 110*c*2. In one or more embodiments, the straw 301*a* may enter the at least one container body 120 when the inverted structural trough element 127 is located above the rolled rim 131 of the cup 130. In one or more embodiments, the horizontal cap wall 110*c*2 of the at least one cover 110*c* may include a straw hole as will be discussed further below.

In at least one embodiment, the at least one cover 110*c* may include an arch shaped straw notch 110*c*3, while the at least one container body 120 may include a straw hole 105*a*. The arch shaped straw notch 110*c*3, in one or more embodiments, in the at least one cover 110*c*, allows the at least one cover 110*c* to be removed from at least one container body 120 without interference from the straw 301*a*, wherein the straw 301*a* remains in the cup 130.

In one or more embodiments, the at least one cover 110*c* may include a straw hole 110*c*4 that is located adjacent to the second inward arched or planar indent 128. The straw hole 110*c*4 may be utilized when the at least one cover 110*c* couples to the exterior wall of the inverted structural trough element 127 or integrated coupling element 121. When the cover 110*c* couples to the exterior wall of the integrated coupling element 121, a straw hole 110*c*4 rather than a straw notch must be utilized. The disadvantage of utilizing a straw hole 110*c*4 in the horizontal cap wall 110*c*2 is that the straw 301*a* remains engaged with the straw hole 110*c*4 when the at least one cover 110*c* is removed from the at least one food container 120. Simply stated, when the at least one cover 110*c* is removed from the at least one food container 120, the straw stays with the at least one cover 110*c* and is removed from the cup 130.

In at least one embodiment of the invention, a single inward arched or planar indent is included, such as the first inward arched or planar indent 128*a* of the at least one container body 120. As such, the straw 301*a* may enter the cup 130 via the first inward arched or planar indent 128*a*, which may be located below the inverted structural trough element 127 when the at least one food container 120 is secured in an elevated position above the rim 131 of the cup 130.

According to one or more embodiments, the coupling element 121 and/or inverted structural trough element 127 may be located above the rolled rim 131, wherein the inverted structural trough element 127 may also serve as a spill retention barrier wall as well as providing a vertically oriented receiving wall for the vertical or horizontal outer edge flange or lip of the at least one cover 110*c*.

In at least one embodiment, the inverted structural trough element 127 may be located at a height that is equal to the height of the rolled rim 131, wherein the inverted structural trough element 127 resides directly over the rolled rim 131, such that an upper interior wall of the inverted structural trough element 127 touches the top surface of the rolled rim 131. According to one or more embodiments, when the structural trough element 127 touches the top surface of the rolled rim 131, and the at least one cover 110*c* is placed on the at least one container body 120, the at least one cover engages with an exterior wall of the inverted structural trough element 127.

According to at least one embodiment of the invention, the at least one cover 110*c* may be a quick press-fit cover, that may be domed shaped, with a vertical flange that quickly press-fits over the substantially vertical sidewall of the inverted structural trough element 127 of the at least one container body 120. As such, in one or more embodiments, when the at least one cover press-fits over the exterior vertical sidewall of the inverted structural trough element 127, a straw hole 110*c*4 is utilized in the horizontal cap wall 110*c*2.

Figure 7:
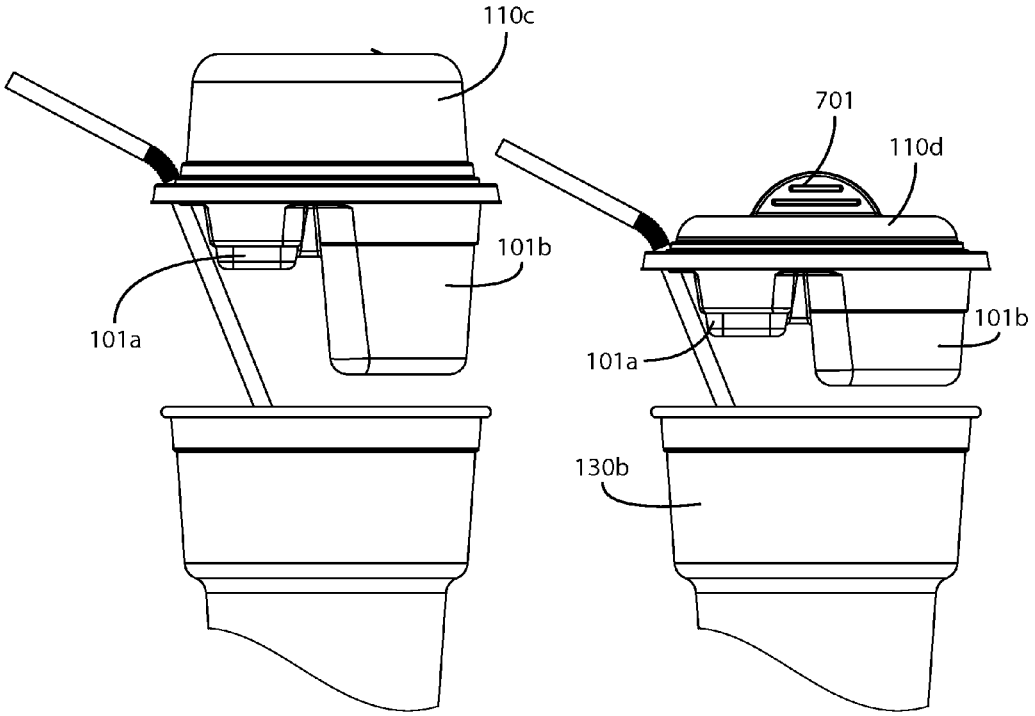
FIG. 7 illustrates side exploded views of various size embodiments of the invention with a plurality of downward oriented cavities that are configured to reside within one size cup.

FIG. 7 illustrates side exploded views of at least one embodiment of the invention with a plurality of downward oriented cavities. In at least one embodiment of the invention, the cup 130 may include a single/one size cup that may accommodate various size food container bodies 120 and various height food container covers 110*c*. As shown in FIG. 7, the at least one container body 120 may include a plurality of downward oriented container cavities 101*a* and 101*b*. Furthermore, in one or more embodiments, the at least one cover may include a domed shaped cover 110*c* and 110*d*, and may include an upward vertically oriented handle 701. In at least one embodiment, the upward vertically oriented handle 701 may be configured in any size or shape that may be integrated into a top surface wall of the at least one cover 110*c*.

In one or more embodiments, the domed shaped food container cover 110*c* or 110*d* may be a variable height domed cover that may be replaceable, and allows for a wider variety of foods of various heights to be placed within the food container, while ensuring the variety of foods remain warm.

Figure 8:
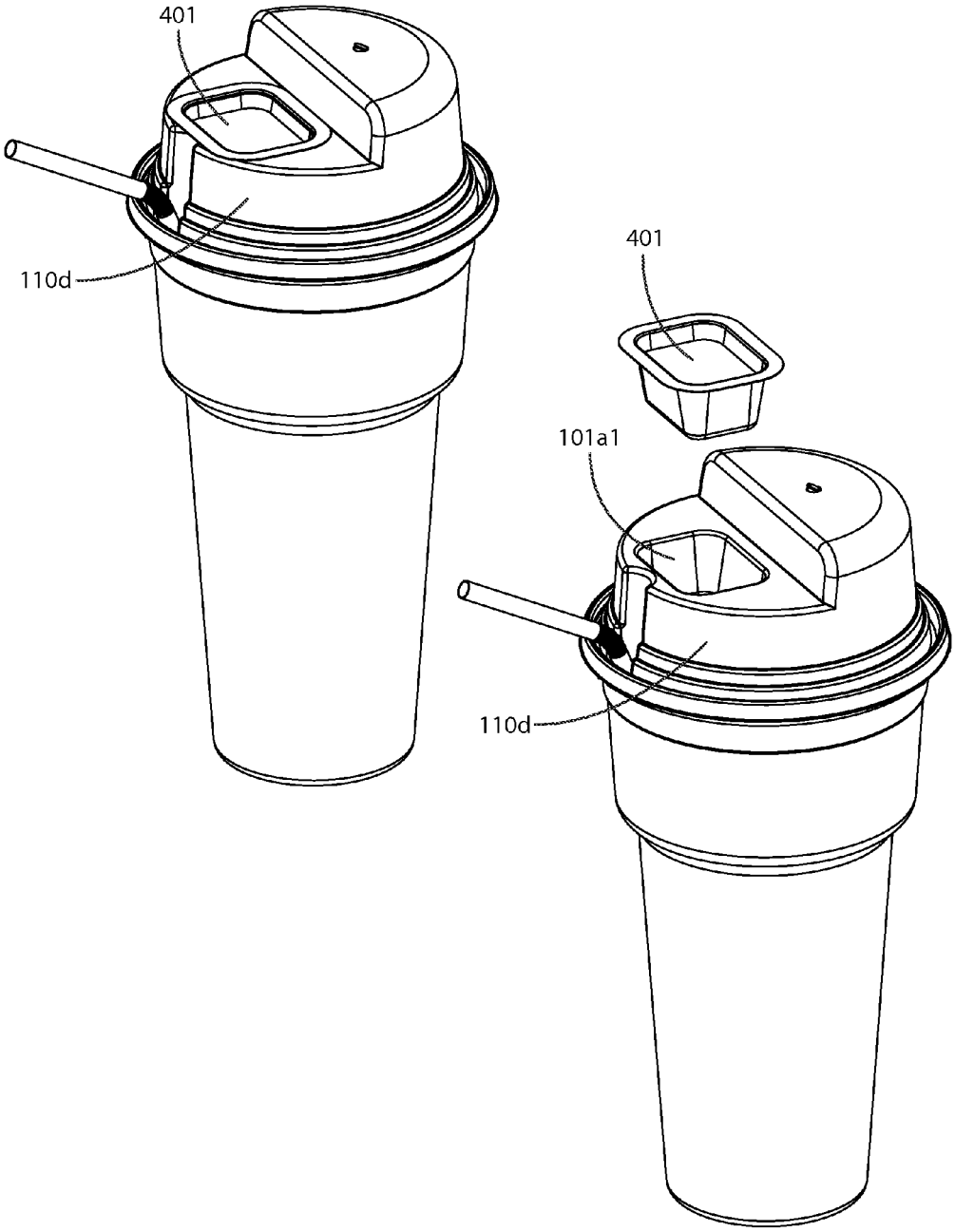
FIG. 8 illustrates a perspective view of at least one embodiment of the invention with a downward oriented cover cavity and independent drop-in cover container shown above the cavity that is configured to hold the drop-in container in the lower right portion of the figure.

FIG. 8 illustrates a perspective view of at least one embodiment of the invention with a downward oriented cover cavity and independent drop-in cover container. In at least one embodiment, cover 110*d*, includes at least one downward oriented cover cavity 101*a*1 or a plurality of downward oriented cover cavities if desired depending on the implementation. As shown, the at least one independent drop-in container 401 may be placed within a respective downward oriented cover cavity 101*a*1.

Figure 9:
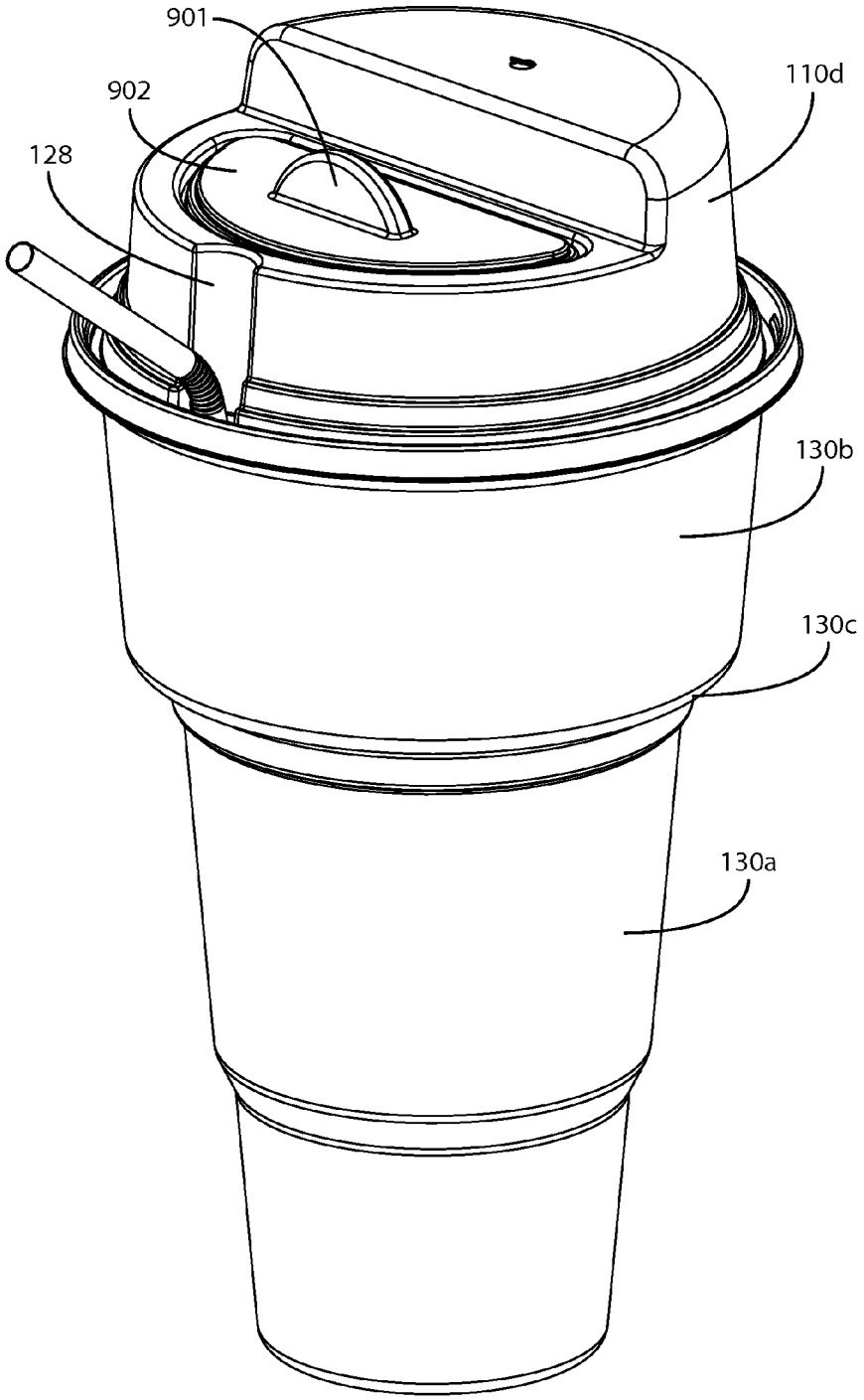
FIG. 9 illustrates a perspective view of at least one embodiment of the invention with at least one cover that demonstrates a replaceable snap-on or press-fit cover that is configured to cover a cavity on the lower cover itself.

FIG. 9 illustrates a perspective view of at least one embodiment of the invention with a replaceable snap-on or press-fit cover. As shown in FIG. 9, by way of one or more embodiments, at least one downward oriented cover cavity 101*a*1 may include at least one replaceable snap-on or press-fit cover 902. In at least one embodiment, each of the at least one replaceable snap-on or press-fit covers 902 may include an upward vertically oriented handle 901. In at least one embodiment, the at least one replaceable snap-on or press-fit cover 902 may be easily snapped-on or quickly pressed-fit over the cavity 101*a*1 (see FIG. 10), and may be easily removed. In one or more embodiments, the at least one downward oriented cover cavities may hold one or more additional items, such as condiment packs, small cookies, candies, toys, utensils or promotional items.

Figure 10:
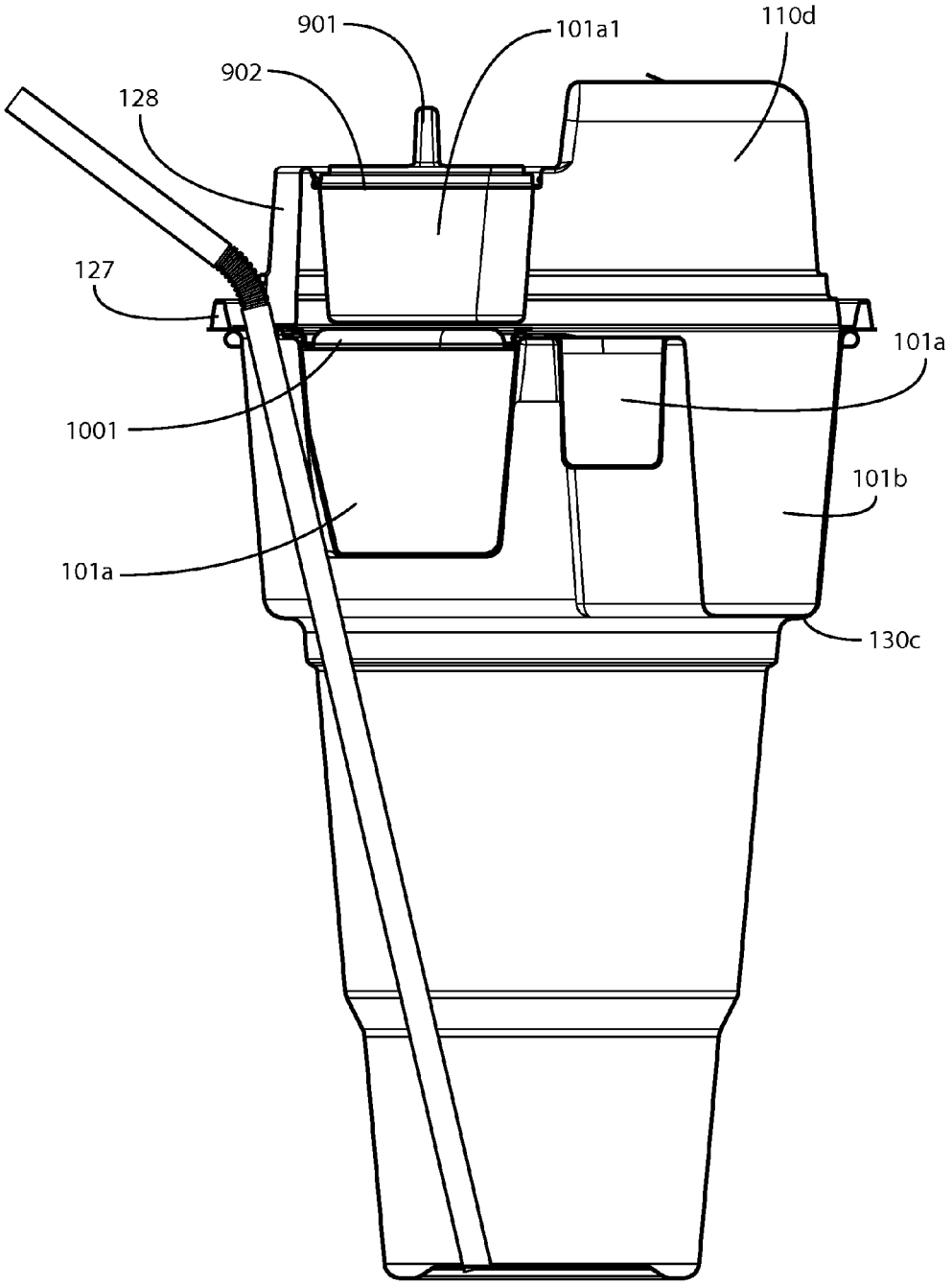
FIG. 10 illustrates a cutaway side view of at least one embodiment of the invention with at least one replaceable snap-on or press-fit cover and a plurality of downward oriented container cavities and independent drop-in containers.

FIG. 10 illustrates a side view of at least one embodiment of the invention with at least one downward oriented cover cavity, at least one replaceable snap-on or press-fit cover, a plurality of downward oriented container cavities and independent drop-in containers. As shown in FIG. 10, in at least one embodiment of the invention, the at least one downward oriented container cavity 101*a* may receive at least one independent drop-in food container 401 and 1202 (see FIG. 13) and at least one independent drop-in food container cover, 1001 for example, that may be configured as a seal-on/peel off cover, or replaceable snap-on or press-fit cover.

According to at least one embodiment of the invention, the at least one downward oriented cover cavity 101*a*1 may be located adjacent to the second inward arched or planar indent 128 that intersects the substantially vertical sidewall of the at least one cover 110*c*. As such, in one or more embodiments, when an independent drop-in cover container 401 is placed in the at least one downward oriented cover cavity 101*a*1, the outer horizontal flange or lip of the independent drop-in condiment container 401 may overhang past an inner edge of the second inward arched or planar indent 128. As such, in at least one embodiment, the overhanging horizontal flange or lip of the at least one drop-in condiment container 401 makes it easy to lift and remove the at least one independent drop-in cover container 401 from the at least one downward oriented cover cavity 101*a*1. In other embodiments the replaceable snap-on or press-fit cover 902 and the upward vertically oriented handle 901 may cover cavity 101*a*1 without an independent drop-in container if desired.

Figure 11:
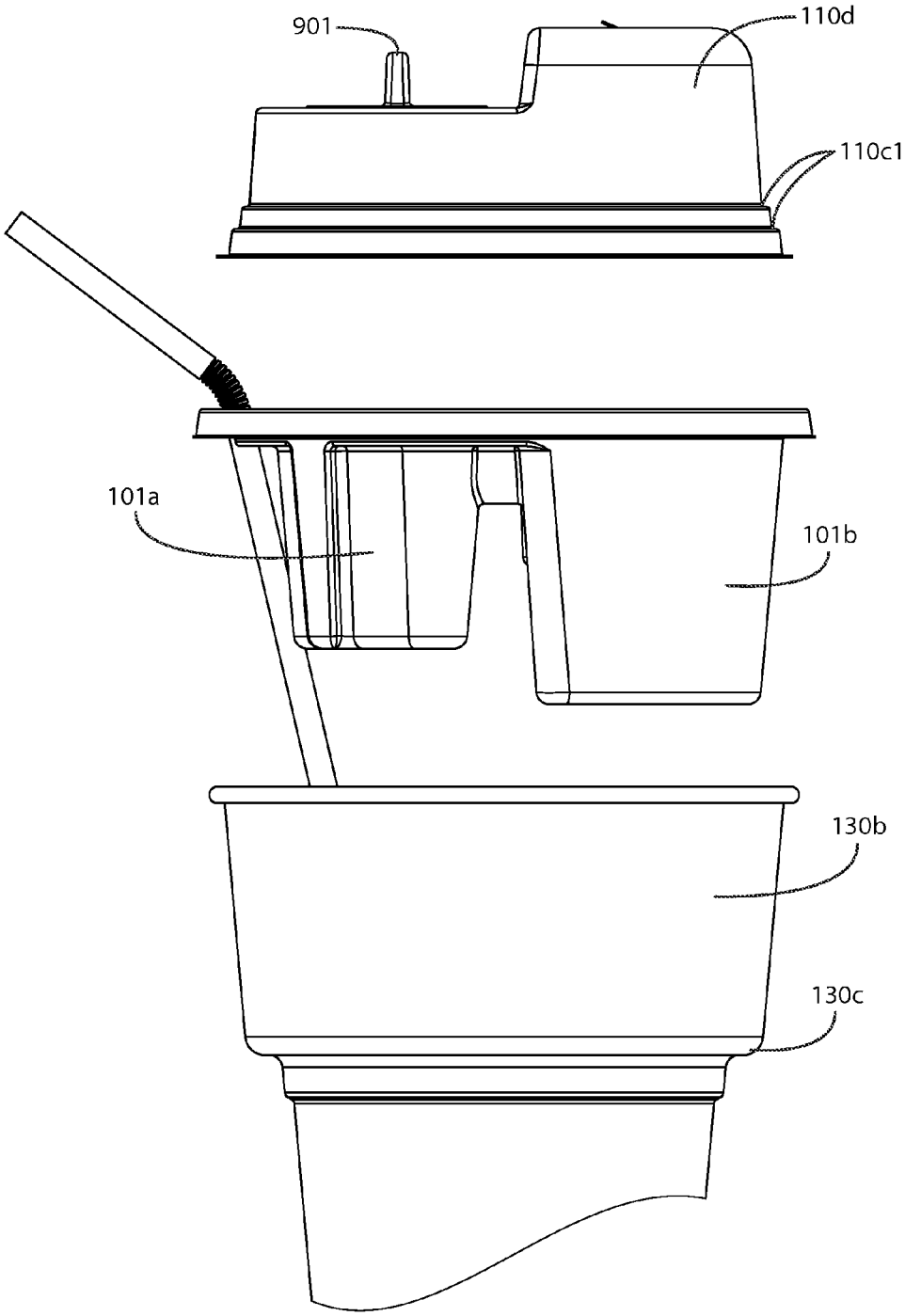
FIG. 11 illustrates an exploded side view of at least one embodiment of the invention with a plurality of downward oriented container cavities and at least one horizontal step wall or strength rib element.

FIG. 11 illustrates an exploded side view of at least one embodiment of the invention with a plurality of downward oriented container cavities and at least one horizontal step wall or strength rib elements 110*c*1 in the at least one cover 110*d*.

Figure 12:
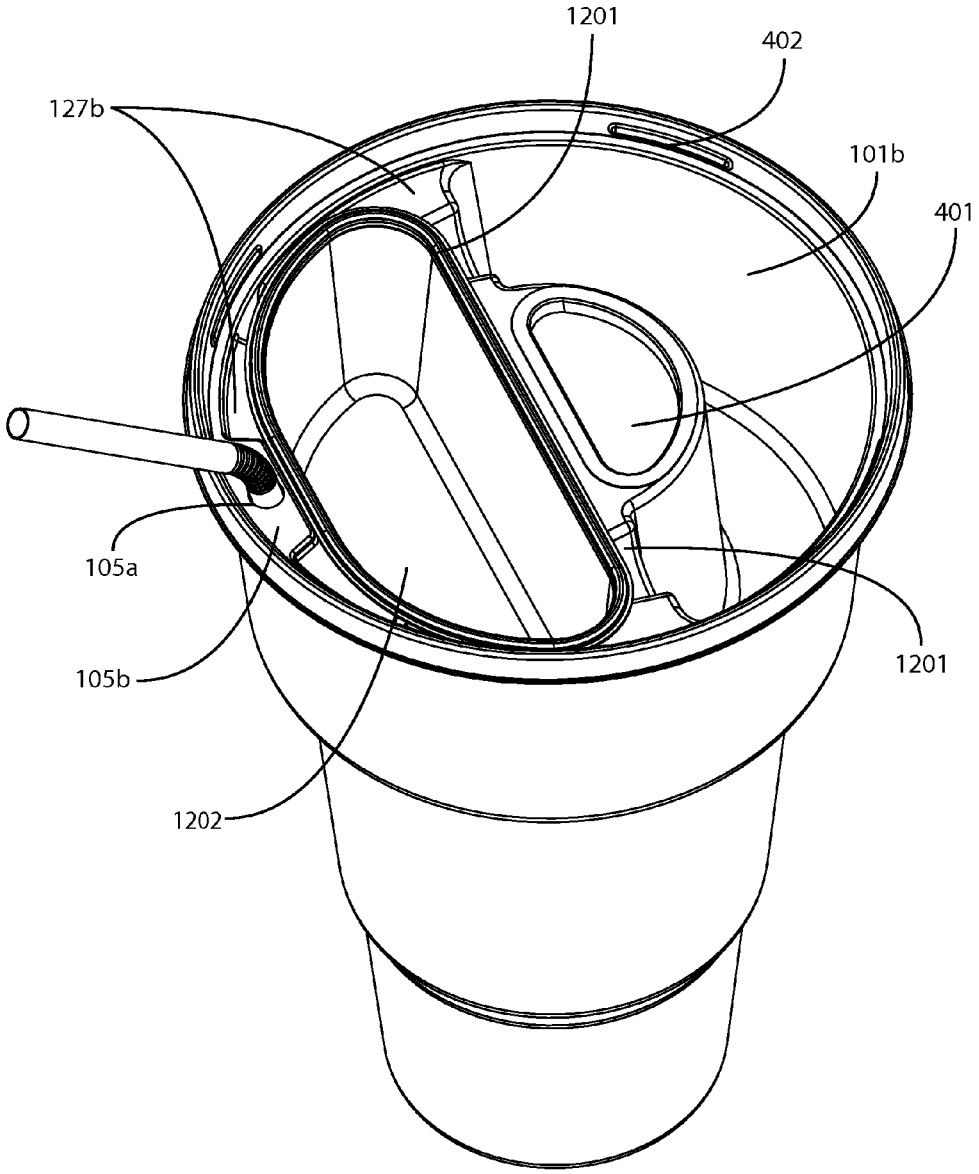
FIG. 12 illustrates top perspective view of at least one embodiment of the invention with the cover removed.
Figure 13:
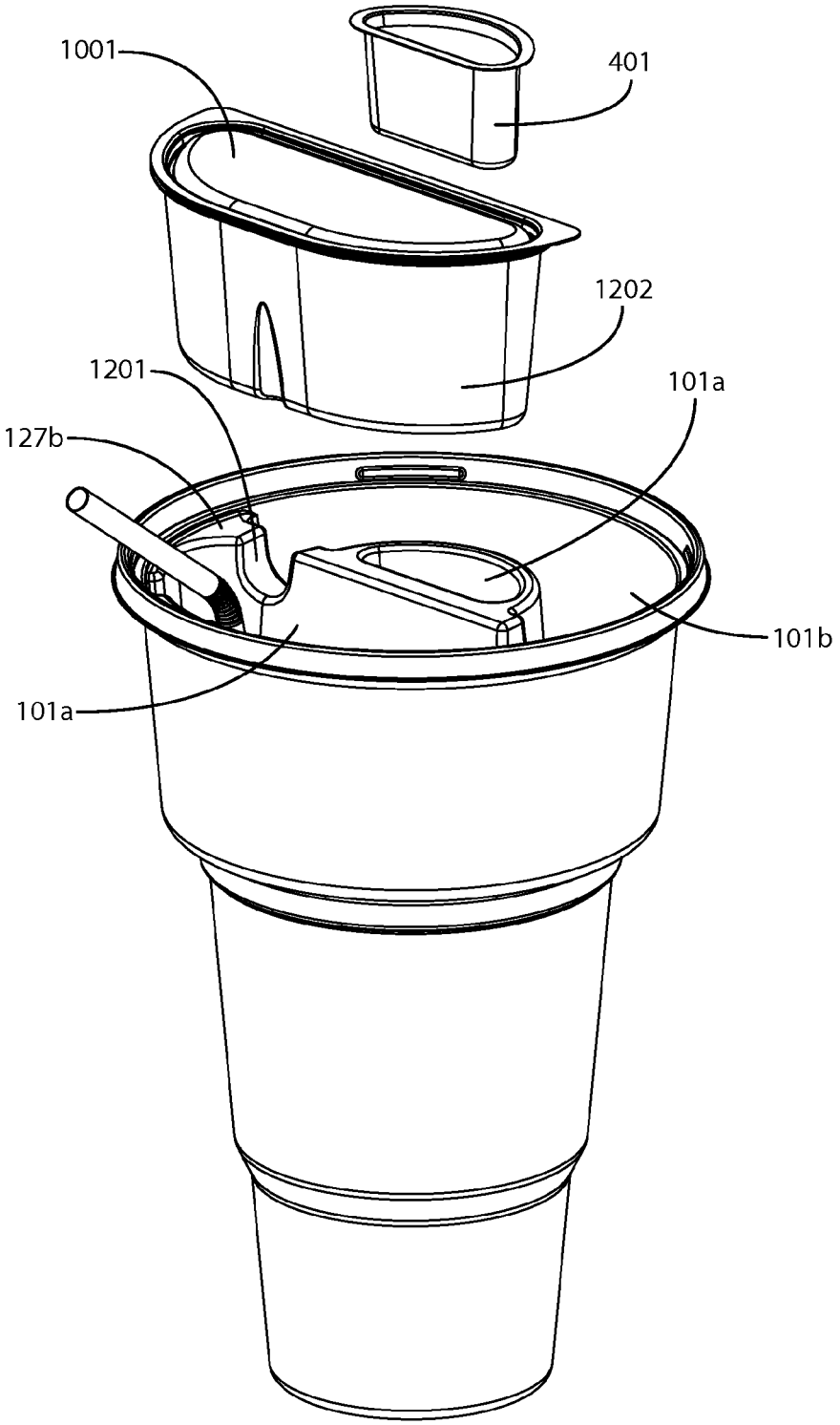
FIG. 13 illustrates a top exploded perspective view of at least one embodiment of the invention with the cover removed and independent drop-in cover containers shown above the respective cavities that are configured to hold the respective drop-in containers.

FIG. 12 illustrates top perspective view of at least one embodiment of the invention with the cover removed, and FIG. 13 illustrates a top exploded perspective view of at least one embodiment of the invention with the cover removed and independent drop-in containers. As shown in FIG. 12 and FIG. 13, in at least one embodiment of the invention, the at least one container body 120 or the at least one downward oriented container cavity of the plurality of downward oriented container cavities 101*a* and 101*b* may receive at least one independent drop-in container 401 and 1202, to hold a solid or a liquid, wherein each of the at least one independent drop-in containers 401 and 1202 may include a replaceable independent drop-in container cover 1001. In one or more embodiments, the at least one container body 120 may include one or more downward arch shaped finger grab indents 1201, that may be located adjacent to the downward oriented container cavity 101*a* that may facilitate easy lifting and removal of the independent drop-in food container 1202 from the downward oriented container cavity 101*a*. In one or more embodiments, the at least one food container 120 may include the recessed top horizontal wall 127*b*.

Figure 14:
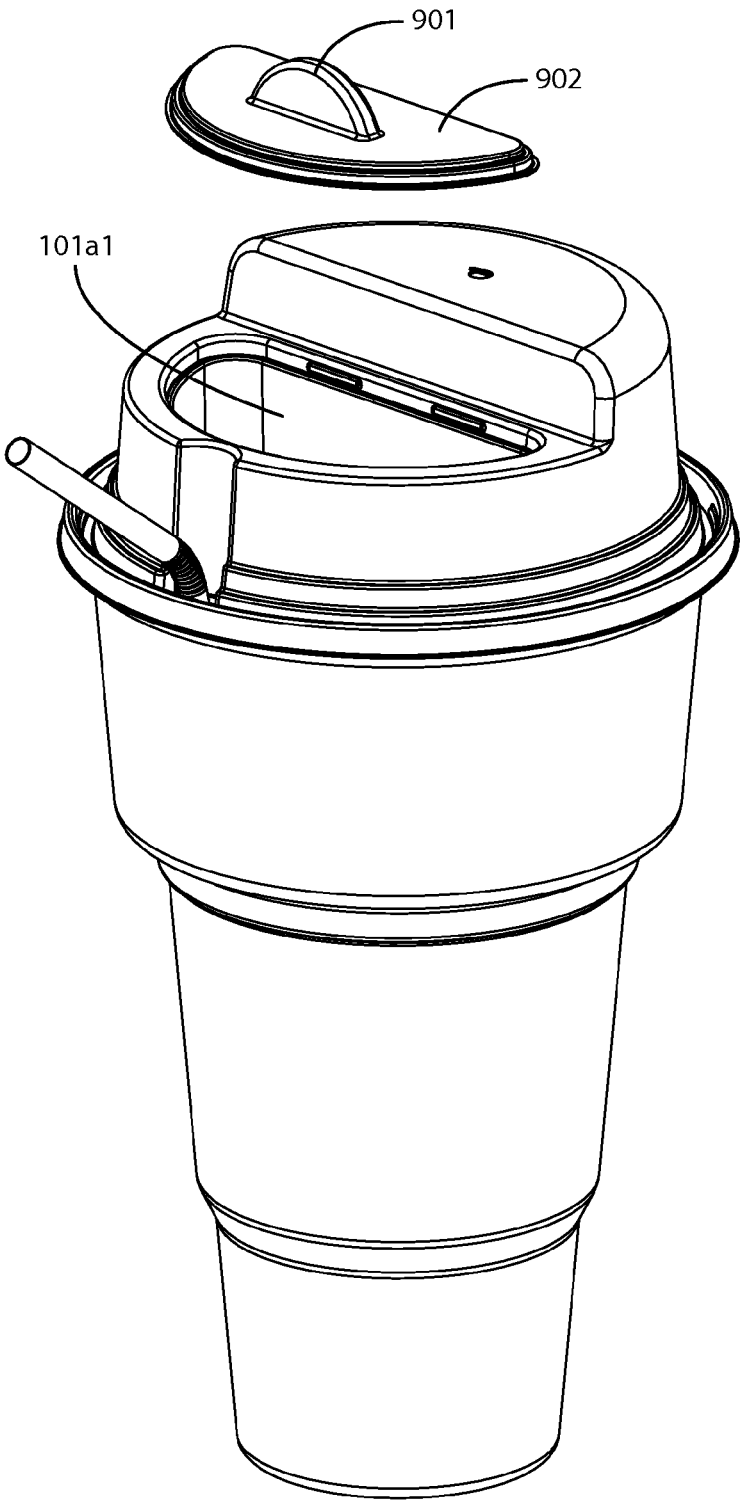
FIG. 14 illustrates a perspective view of at least one embodiment of the invention with at least one cover that demonstrates a replaceable snap-on or press-fit cover and downward oriented cover cavity.

FIG. 14 illustrates a perspective view of at least one embodiment of the invention with a replaceable snap-on or press-fit cover and downward oriented cover cavity. As shown in FIG. 14, according to one or more embodiments of the invention, the at least one cover 110*c* may include at least one downward oriented cavity 101*a*1, and a replaceable snap-on or press-fit cover 902 and the upward vertically oriented handle 901.

While the invention herein disclosed has been described by means of specific embodiments and applications thereof, numerous modifications and variations could be made thereto by those skilled in the art without departing from the scope of the invention set forth in the claims. Various configurations of the invention have been shown—each containing individual embodiments. For the sake of brevity and repetition not all embodiments have been mentioned in every configuration. The embodiments described herein may implement or combine any features from any other embodiment and as such any new configuration/embodiment combination, which arises from embodiments herein, is in keeping with the spirit of the invention.

What is claimed is:

1. A cup with nestable food container and cover comprising:

a food container comprising at least one wall that defines at least one container body configured to store a first solid or liquid of food;

wherein said at least one container body comprises an outer edge area; and, a plurality of downward oriented container cavities;

wherein each of said plurality of downward oriented cavities comprises a bottom outer corner portion;

at least one cover configured to enclose said food container;

a cup comprising a substantially vertical sidewall comprising a lower cup body, an upper cup body having a portion that is wider than said lower cup body, wherein the portion that is wider in said upper cup body with respect to said lower cup body defines a fill line configured to indicate a volume of a second solid or liquid of beverage to fill said cup with, and, wherein said second solid or liquid is separate from said first solid or liquid stored in said food container; and, an annular opening, wherein said annular opening lies in an annular plane on top of said cup;

wherein said at least one container body is configured to contact said first solid or liquid on one side and said second solid or liquid on an opposing side of said at least one wall;

wherein said upper cup body is configured to hold said food container; and, wherein said at least one container body is configured to descend into said annular opening of said cup toward said fill line.

2. The cup with nestable food container and cover of claim 1, wherein said at least one container body further comprises at least one dividing wall defining said plurality of downward oriented container cavities configured to hold said first solid or liquid.

3. The cup with nestable food container and cover of claim 1, wherein said at least one container body further comprises a plurality of container bodies, wherein said plurality of container bodies each comprise said plurality of downward oriented container cavities that vary in one or more of size, shape and depth that fit within one size of said cup.

4. The cup with nestable food container and cover of claim 1, wherein said at least one cover further comprises a plurality of covers, wherein said plurality of covers vary in one or more of height and shape.

5. The cup with nestable food container and cover of claim 1, wherein said at least one cover further comprises at least one downward oriented cover cavity.

6. The cup with nestable food container and cover of claim 5, wherein said at least one downward oriented cover cavity comprises at least one replaceable snap-on or press-fit cover.

7. The cup with nestable food container and cover of claim 1, wherein at least one downward oriented container cavity of said plurality of downward oriented container cavities is configured to receive an independent drop-in container with an independent drop-in container cover.

8. The cup with nestable food container and cover of claim 1, wherein said at least one container body further comprises a first inward arched or planar indent.

9. The cup with nestable food container and cover of claim 8, wherein said at least one cover comprises a second inward arched or planar indent.

10. The cup with nestable food container and cover of claim 8, wherein said at least one cover comprises a second inward arched or planar indent that is located under a flange or lip of a drop-in container to enable the drop-in container to be lifted from a cavity in the at least one cover.

11. The cup with nestable food container and cover of claim 1, wherein said at least one container body further comprises a first inward arched or planar indent, and wherein said food container further comprises at least one cover comprising a second inward arched or planar indent.

12. The cup with nestable food container and cover of claim 9, wherein each of said at least one cover and said at least one container body comprise a substantially vertical sidewall, such that both said first inward arched or planar indent and said second inward arched or planar indent are configured to intersect said substantially vertical sidewalls of said at least one cover and said at least one container body.

13. The cup with nestable food container and cover of claim 11, wherein said at least one cover comprises an outer horizontal diameter lip and a first horizontal cap wall, and wherein the at least one food container body comprises an outer edge area and a second horizontal cap wall, such that said first and second inward arched or planar indents are perpendicularly intersected by said first and second horizontal cap walls.

14. The cup with nestable food container and cover of claim 13, wherein at least one of said first and second horizontal cap walls comprises a straw notch or straw hole configured to accept a straw.

15. The cup with nestable food container and cover of claim 14, wherein said first and second horizontal cap walls are configured to meet and be flush with one another when said at least one cover is placed on said at least one container body, such that said flush horizontal cap walls form a double wall liquid retention barrier configured to surround a location of where said straw enters said straw notch or straw hole.

16. The cup with nestable food container and cover of claim 13 wherein the at least one container body further comprises a recessed top horizontal wall of a depth of a lip or flange of an independent drop-in container, such that when the independent drop-in container is inserted into at least one cavity of the plurality of downward oriented cavities, the at least one cover is configured to become flush with the second horizontal cap wall and top surface of the lip or flange of the independent drop-in container.

17. The cup with nestable food container and cover of claim 1, wherein said outer edge area of said at least one container body comprises an integrated coupling element configured to couple said at least one container body to said at least one cover.

18. The cup with nestable food container and cover of claim 1, wherein said outer edge area of said at least one container body comprises an inverted structural trough element.

19. The cup with nestable food container and cover of claim 1, wherein said at least one cover further comprises an outer edge, and vertically oriented flange or lip or a horizontally oriented flexible flange/lip located at said outer edge.

20. The cup with nestable food container and cover of claim 19, wherein said at least one container body or said at least one cover comprises an integrated coupling element at an outer edge area that comprises an inner surface, and wherein said inner surface further comprises at least one male snap/bump element integrated into said inner surface of said integrated coupling element, such that said at least one horizontally oriented flexible flange/lip is configured to snap over said at least one male snap/bump element.

21. The cup with nestable food container and cover of claim 17, wherein said integrated coupling element resides above said annular plane on said top of said cup.

22. The cup with nestable food container and cover of claim 17, wherein said integrated coupling element is configured as a spill retention barrier wall.

23. The cup with nestable food container and cover of claim 17, wherein said cup further comprises a rolled rim with a top surface, and wherein said integrated coupling element resides directly over and touches said top surface of said rolled rim.

24. The cup with nestable food container and cover of claim 8, wherein said first inward arched or planar indent comprises an inverted trough dividing wall travelling diagonally across said at least one container body.

25. The cup with nestable food container and cover of claim 8, wherein said first inward arched or planar indent comprises an inverted trough dividing wall travelling diagonally across said at least one container body and wherein said food container is secured in an elevated position such that a straw may enter the inverted trough dividing wall without preceding through a straw hole that resides in a horizontally oriented cap well element.

26. The cup with nestable food container and cover of claim 1, wherein said substantially vertical sidewall of said cup further comprises at least one horizontal step wall or strength rib element integrated into said upper cup body and wherein said at least one container body further comprises a second horizontal step wall or strength rib element configured to rest on said at least one horizontal step wall or strength rib element.

27. The cup with nestable food container and cover of claim 1 wherein said bottom outer corner portion of at least one of said plurality of downward oriented cavities is configured to rest on said portion that is wider in said upper cup body with said bottom outer portion.

28. A cup with nestable food container and cover comprising:

a food container comprising at least one wall that defines at least one container body configured to store a first solid or liquid of food;

wherein said at least one container body comprises an outer edge area; and, a plurality of downward oriented container cavities;

wherein each of said plurality of downward oriented cavities comprises a bottom outer corner portion;

at least one cover configured to enclose of said food container;

a cup comprising a substantially vertical sidewall comprising a lower cup body, an upper cup body having a portion that is wider than said lower cup body, wherein the portion that is wider in said upper cup body with respect to said lower cup body defines a fill line configured to indicate a volume of a second sold or liquid of beverage to fill said cup with, and, wherein said second solid or liquid is separate from said first solid or liquid stored in said food container; and, an annular opening, wherein said annular opening lies in an annular plane on top of said cup;

wherein said at least one container body is configured to contact said first solid or liquid on one side and said second solid or liquid on an opposing side of said at least one wall;

wherein said upper cup body is configured to hold said food container;

wherein said at least one container body is configured to descend into said annular opening of said cup toward said fill line;

wherein said bottom outer corner portion of at least one of said plurality of downward oriented cavities is configured to rest on said portion that is wider in said upper cup body with said bottom outer portion;

wherein said at least one cover comprises a first horizontal cap wall, and said at least one container further comprises a second horizontal cap wall;

wherein said at least one cover and at least one container body further comprise an outer edge, flange or lip and wherein said outer edge, flange or lip are located adjacent to said first and second horizontal cap walls respectively, such that said first and second inward arched or planar indents are perpendicularly intersected by said first and second horizontal cap walls respectively;

wherein at least one of said first and second horizontal cap walls comprises a straw notch or straw hole configured to accept a straw; and, wherein said first and second horizontal cap walls are configured to meet and be flush with one another when said at least one cover is placed on said at least one container body, such that said flush horizontal cap walls form a double wall liquid retention barrier configured to surround a location of where said straw enters said straw notch or straw hole.

* * * * *